US012117191B2

(12) United States Patent
Epperson et al.

(10) Patent No.: US 12,117,191 B2
(45) Date of Patent: Oct. 15, 2024

(54) CLIMATE CONTROL SYSTEM WITH IMPROVED LEAK DETECTOR

(71) Applicant: Trane International Inc., Davidson, NC (US)

(72) Inventors: Daren Lee Epperson, Tyler, TX (US); Leslie Lynn Zinger, Bullard, TX (US); Henry Traver Berry, Austin, TX (US); Chad Daniel Bowers, Adams, TN (US); Lane A. Liudahl, Holmen, WI (US); Jeffrey L. Stewart, Whitehouse, TX (US); Timothy Schmitt, Flint, TX (US)

(73) Assignee: Trane International Inc., Davidson, NC (US)

( * ) Notice: Subject to any disclaimer, the term of this patent is extended or adjusted under 35 U.S.C. 154(b) by 70 days.

(21) Appl. No.: 17/808,780

(22) Filed: Jun. 24, 2022

(65) Prior Publication Data

US 2023/0417435 A1 Dec. 28, 2023

(51) Int. Cl.
*F24F 11/36* (2018.01)
*F24F 11/48* (2018.01)
(Continued)

(52) U.S. Cl.
CPC ..... *F24F 11/36* (2018.01); *F24F 11/48* (2018.01); *F24F 11/89* (2018.01); *F24F 13/222* (2013.01)

(58) Field of Classification Search
CPC .. F24F 11/36; F24F 11/48; F24F 11/89; F24F 13/222
See application file for complete search history.

(56) References Cited

U.S. PATENT DOCUMENTS 4,711,096 A 12/1987 Krantz
5,284,027 A 2/1994 Martin, Sr.
(Continued)

FOREIGN PATENT DOCUMENTS

BR 112019010410 A2 9/2019
CA 3065728 C 6/2021
(Continued)

OTHER PUBLICATIONS

US 11,402,122 B2, 09/2022, Tsuji (withdrawn)

*Primary Examiner* — Nelson J Nieves
(74) *Attorney, Agent, or Firm* — WOMBLE BOND DICKINSON (US) LLP

(57) ABSTRACT

Examples of the present disclosure relate to climate control systems and air handler units with improved leak detection, along with method for installing these systems. In some examples, the climate control system comprises a heat exchanger configured to exchange thermal energy between a conditioned airflow and a refrigerant fluid; a drain pan arranged to collect condensate produced at the heat exchanger, the drain pan including one or more drains configured to route condensate out of the drain pan; a refrigerant leak sensor coupled to the drain pan and positioned above the one or more drains and configured to detect a refrigerant leak; and control circuitry operably coupled to the refrigerant leak sensor, the control circuitry configured to: receive a signal from the refrigerant leak sensor indicative of refrigerant located outside the closed circuit associated with the heat exchanger, and determine a refrigerant leak has occurred based on the signal.

47 Claims, 11 Drawing Sheets

(51) Int. Cl.
*F24F 11/89* (2018.01)
*F24F 13/22* (2006.01)

(56) References Cited

U.S. PATENT DOCUMENTS 5,742,066 A 4/1998 Cavestri
5,820,262 A 10/1998 Lechner
5,918,475 A 7/1999 Sakakibara
6,085,531 A 7/2000 Numoto
6,321,556 B1 11/2001 Tesche et al.
6,442,955 B1 9/2002 Oakner et al.
6,644,047 B2 11/2003 Taira
6,655,161 B1 12/2003 Koo
6,701,722 B1 3/2004 Seo
6,742,384 B2 6/2004 Avila
6,772,598 B1 8/2004 Rinehart
6,791,088 B1 9/2004 Williams
6,889,537 B2 5/2005 Anderson
7,143,591 B2 12/2006 Nonaka
7,181,954 B2 2/2007 Horie
7,631,508 B2 12/2009 Braun et al.
7,647,784 B2 1/2010 Mizutani et al.
7,752,853 B2 7/2010 Singth et al.
7,814,757 B2 10/2010 Zima
7,946,121 B2 5/2011 Yamaguchi et al.
7,987,679 B2 8/2011 Tanaka
8,005,648 B2 8/2011 Johnson
8,070,355 B2 12/2011 Minor
8,180,495 B1 5/2012 Roy
8,302,414 B2 11/2012 Hisaoka
8,402,779 B2 3/2013 Nishimura et al.
8,570,179 B2 10/2013 Holloway
8,695,404 B2 4/2014 Kadle
8,786,437 B2 7/2014 Breed
8,899,099 B2 12/2014 Grosse Bley
9,164,519 B2 10/2015 Holloway
9,291,378 B2 3/2016 Ueda et al.
9,541,319 B2 1/2017 Morimoto
9,568,227 B2 2/2017 Douglas et al.
9,625,195 B2 4/2017 Hiraki et al.
9,726,410 B2 8/2017 Gao
9,791,195 B2 10/2017 Okada et al.
9,869,499 B2 1/2018 Liu et al.
10,088,202 B2 10/2018 Huff et al.
10,126,012 B2 11/2018 Ikawa
10,126,031 B2 11/2018 Shockley
10,151,663 B2 12/2018 Scancarello
10,203,136 B2 2/2019 Nishimura
10,247,441 B2 4/2019 Suzuki
10,354,332 B2 7/2019 Trainor
10,399,412 B2 9/2019 Mathe
10,401,253 B2 9/2019 Cooper et al.
10,408,484 B2 9/2019 Honda et al.
10,408,488 B2 9/2019 Suzuki
10,416,113 B2 9/2019 Chen et al.
10,424,190 B2 9/2019 Zribi et al.
10,458,689 B2 10/2019 Suzuki
10,479,170 B2 11/2019 Enomoto et al.
10,480,807 B2 11/2019 Goel et al.
10,488,066 B2 11/2019 Honda et al.
10,488,072 B2 11/2019 Yajima et al.
10,508,847 B2 12/2019 Yajima et al.
10,539,358 B2 1/2020 Suzuki
10,557,648 B2 2/2020 Naito et al.
10,584,890 B2 3/2020 Steinberg
10,605,505 B2 3/2020 Appler et al.
10,634,404 B2 4/2020 Obara
10,641,268 B2 5/2020 Brostrom et al.
10,655,884 B2 5/2020 Iura et al.
10,677,679 B2 6/2020 Gupte
10,712,035 B2 7/2020 Yamada et al.
10,714,772 B2 7/2020 Nishida et al.
10,724,766 B2 7/2020 Suzuki
10,767,881 B2 9/2020 Wang
10,767,882 B2 9/2020 Kowald et al.
10,782,040 B2 9/2020 Wacker
10,808,960 B2 10/2020 Suzuki
10,816,232 B2 10/2020 Crawford et al.
10,816,247 B2 10/2020 McQuade
10,823,445 B2 11/2020 Suzuki
10,928,091 B2 2/2021 Crawford et al.
10,935,454 B2 3/2021 Kester
10,941,956 B2 3/2021 Gao et al.
11,015,852 B2 4/2021 Sakae et al.
10,996,131 B2 5/2021 McQuade et al.
11,002,467 B2 5/2021 Wada et al.
11,015,828 B2 5/2021 Sakae
11,015,834 B2 5/2021 Kageyama et al.
11,022,346 B2 6/2021 Sun et al.
11,041,647 B2 6/2021 Weinert
11,041,666 B2 6/2021 Sakae et al.
11,067,303 B2 * 7/2021 Obara ..... F24F 11/36
11,067,321 B2 7/2021 Suzuki
11,079,149 B2 8/2021 Papas et al.
11,079,300 B2 8/2021 Shi
11,092,566 B2 8/2021 Chen et al.
11,098,915 B2 8/2021 Crawford
11,117,449 B2 9/2021 Renault
11,118,821 B2 9/2021 Matsuda
11,118,822 B2 9/2021 Kujak
11,125,457 B1 9/2021 Alfano et al.
11,131,470 B2 9/2021 Mindamida et al.
11,137,184 B2 10/2021 Yamada et al.
11,143,439 B2 10/2021 Matsuda et al.
11,150,156 B2 10/2021 Nanba et al.
11,162,725 B2 11/2021 Suzuki et al.
11,175,060 B2 11/2021 Mowris
11,199,337 B2 12/2021 Kawashima
11,231,199 B2 1/2022 Ikeda
11,248,816 B2 2/2022 Ikawa et al.
11,260,728 B2 3/2022 Kondrk
11,262,097 B2 3/2022 Suzuki
11,268,718 B2 3/2022 Minamida
11,274,866 B2 3/2022 Yamada
11,274,871 B2 3/2022 Sakae
11,280,507 B2 3/2022 Yoneyama
11,280,523 B2 3/2022 Sakae
11,293,674 B2 4/2022 Yamada
11,306,954 B2 4/2022 Arensmeier
11,346,570 B2 5/2022 Yoshimi
11,353,247 B2 6/2022 Bernhardt
11,359,846 B2 6/2022 Welch
11,378,313 B2 7/2022 Goel
11,378,316 B2 7/2022 Walser
11,407,287 B2 8/2022 Repice
11,408,624 B2 8/2022 Hovardas
11,428,435 B2 8/2022 Eskew
11,435,102 B2 9/2022 Watanabe
11,435,124 B2 9/2022 Kondrk
11,441,803 B2 9/2022 Goel
11,441,813 B2 9/2022 Tsuji
11,441,820 B2 9/2022 Weyna
11,472,265 B2 10/2022 Stockbridge
11,506,411 B2 11/2022 Shirai
11,530,830 B2 12/2022 Watanabe
11,536,502 B2 12/2022 Yajima
11,573,149 B2 2/2023 Gupte
11,578,887 B2 2/2023 Delgoshaei
11,598,560 B2 3/2023 Yajima
11,604,019 B2 3/2023 Alfano
11,604,156 B2 3/2023 Chen
11,609,009 B2 3/2023 Blanton
11,609,031 B2 3/2023 Matsuda
11,609,032 B2 3/2023 Butler
11,609,046 B2 3/2023 Thobias
11,614,249 B2 3/2023 Chen
11,635,339 B2 4/2023 Willett
11,644,225 B2 5/2023 Delgoshaei
11,674,727 B2 6/2023 De
2004/0168505 A1 9/2004 Dudley
2008/0295580 A1 12/2008 Minor
2009/0107157 A1 4/2009 Dube
2011/0112814 A1 5/2011 Clark
2011/0277541 A1 11/2011 Kadle et al.

(56) References Cited

U.S. PATENT DOCUMENTS

2012/0071082 A1 3/2012 Karamanos
2013/0213068 A1 8/2013 Goel
2017/0122833 A1 5/2017 Furry
2018/0327179 A1 11/2018 Papas
2019/0133341 A1 5/2019 Fischer
2019/0170384 A1 6/2019 McQuade
2019/0170599 A1 6/2019 Kester
2019/0170600 A1 6/2019 Tice
2019/0170603 A1 6/2019 Gupte
2019/0195542 A1 6/2019 Hansen et al.
2019/0195550 A1 6/2019 Sakae et al.
2019/0264963 A1 8/2019 Kondrk
2019/0316820 A1 10/2019 Zhai et al.
2019/0316821 A1 10/2019 Zhai et al.
2019/0390877 A1 12/2019 Sakae et al.
2020/0011560 A1 1/2020 Minamida
2020/0033036 A1 1/2020 Yamada et al.
2020/0049361 A1 2/2020 Minamida et al.
2020/0110000 A1 4/2020 Roth
2020/0124493 A1 4/2020 Duerr
2020/0166470 A1 5/2020 Chen et al.
2020/0182734 A1 6/2020 Ueno et al.
2020/0208861 A1 7/2020 Chen
2020/0232685 A1 7/2020 Swab
2020/0240869 A1 7/2020 Yesh et al.
2020/0263891 A1 8/2020 Noor et al.
2020/0271344 A1 8/2020 Ikeda et al.
2020/0300522 A1 9/2020 Inao et al.
2020/0309434 A1 10/2020 Walser et al.
2020/0318887 A1* 10/2020 Tsutsumi ..... F24F 11/88
2020/0324624 A1 10/2020 Repice et al.
2020/0355420 A1 11/2020 Goel et al.
2020/0386431 A1 12/2020 Kondrk
2020/0393140 A1 12/2020 Nouchi
2021/0001689 A1 1/2021 Kondrk et al.
2021/0018199 A1 1/2021 Blanton
2021/0071887 A1 3/2021 Jaber et al.
2021/0095876 A1 4/2021 Branson et al.
2021/0095887 A1 4/2021 Kilgo
2021/0108819 A1 4/2021 Chen
2021/0108820 A1 4/2021 Hovardas
2021/0108857 A1 4/2021 Thobias et al.
2021/0123624 A1 4/2021 Kronstrom
2021/0131696 A1 5/2021 She et al.
2021/0140650 A1 5/2021 Wilson
2021/0140662 A1 5/2021 Goel et al.
2021/0148620 A1 5/2021 Yamada et al.
2021/0164678 A1 6/2021 Delgoshaei
2021/0190353 A1 6/2021 Blanton
2021/0199359 A1 7/2021 Grabon
2021/0207830 A1 7/2021 Chen
2021/0207831 A1 7/2021 Lord et al.
2021/0213802 A1 7/2021 Poolman et al.
2021/0215413 A1 7/2021 Deaville
2021/0229528 A1 7/2021 Stockbridge
2021/0247086 A1 8/2021 Sasaki et al.
2021/0247096 A1 8/2021 Hovardas
2021/0268875 A1 9/2021 Weyna et al.
2021/0278128 A1 9/2021 Scarcella et al.
2021/0285680 A1 9/2021 Atchison et al.
2021/0285840 A1 9/2021 Willett
2021/0293430 A1 9/2021 Yamada
2021/0293431 A1 9/2021 Delgoshaei
2021/0293446 A1 9/2021 Fard
2021/0302056 A1* 9/2021 Eskew ..... G01M 1/122
2021/0310678 A1 10/2021 Weinert
2021/0348820 A1 11/2021 Kobayashi et al.
2021/0356150 A1 11/2021 Green et al.
2021/0356154 A1* 11/2021 Kobayashi ..... F25B 49/02
2021/0356155 A1 11/2021 Yoshimi et al.
2021/0364180 A1 11/2021 Chen
2021/0396413 A1 12/2021 Maddox et al.
2021/0396696 A1 12/2021 Hornung
2021/0404685 A1 12/2021 Butler et al.
2022/0003443 A1* 1/2022 Kobayashi ..... F24F 5/00
2022/0003471 A1 1/2022 Welch
2022/0003472 A1 1/2022 Okuda et al.
2022/0034535 A1* 2/2022 Kobayashi ..... F25B 13/00
2022/0034568 A1 2/2022 Satou
2022/0042698 A1 2/2022 Butler
2022/0057100 A1 2/2022 Ikeda
2022/0065832 A1 3/2022 Oggianu
2022/0082304 A1 3/2022 Welch
2022/0090979 A1 3/2022 Kester
2022/0099346 A1 3/2022 Alfano
2022/0128253 A1 4/2022 Suzuki
2022/0128277 A1 4/2022 Fukuyama
2022/0128278 A1 4/2022 Parker
2022/0128281 A1 4/2022 Tsuji
2022/0134844 A1 5/2022 Palmisano
2022/0146132 A1 5/2022 McQuade
2022/0170654 A1 6/2022 Delgoshaei
2022/0186960 A1 6/2022 Hirai
2022/0221184 A1 7/2022 Gupta
2022/0243938 A1 8/2022 Notaro
2022/0243939 A1 8/2022 Notaro
2022/0243940 A1 8/2022 Notaro
2022/0243941 A1 8/2022 Notaro
2022/0252291 A1 8/2022 Alfano
2022/0252304 A1 8/2022 Green
2022/0297510 A1 9/2022 Kondrk
2022/0307711 A1 9/2022 Lord
2022/0307740 A1 9/2022 Lord
2022/0307937 A1 9/2022 Thyssen
2022/0341612 A1 10/2022 West
2022/0341804 A1 10/2022 West
2022/0349600 A1 11/2022 Alfano
2022/0397297 A1 12/2022 Foster
2023/0009291 A1 1/2023 Hjortland
2023/0032795 A1 2/2023 Sunderland
2023/0048352 A1 2/2023 Wright
2023/0058790 A1 2/2023 Rumler
2023/0085125 A1 3/2023 Yamaguchi
2023/0107694 A1 4/2023 Kawano
2023/0109334 A1 4/2023 Welch
2023/0117306 A1 4/2023 Petele

FOREIGN PATENT DOCUMENTS

CN 110375466 A 10/2019
CN 110375467 A 10/2019
CN 110646362 A 1/2020
CN 109073262 B 8/2020
DE 102019205908 A1 10/2020
DE 102017217685 B4 10/2021
EP 0783099 A1 7/1997
EP 2354724 A3 11/2014
EP 3054231 B1 7/2018
EP 3374701 A1 9/2018
EP 3457044 A4 5/2019
EP 3460347 A4 5/2019
EP 3428554 B1 7/2019
EP 3425295 B1 9/2019
EP 3321607 B1 12/2019
EP 3405629 A4 1/2020
EP 3683518 A1 7/2020
EP 3693687 A3 10/2020
EP 3730854 A1 10/2020
EP 3751209 A1 12/2020
EP 3534084 B1 2/2021
EP 3584522 B1 4/2021
EP 3798527 A4 5/2021
EP 3816542 A1 5/2021
EP 3040654 B1 6/2021
EP 3875861 A1 9/2021
EP 3901526 A1 10/2021
EP 3901530 A1 10/2021
EP 3859223 A4 11/2021
EP 3859249 A4 11/2021
EP 3906382 A1 11/2021
EP 3911931 A2 11/2021
EP 3686520 B1 12/2021
EP 3919837 A1 12/2021
EP 3943858 A1 1/2022

(56) References Cited

FOREIGN PATENT DOCUMENTS

| | | | |
|---|---|---|---|
| EP | 3961119 | A1 | 3/2022 |
| EP | 3974032 | A1 | 3/2022 |
| EP | 4033165 | A1 | 7/2022 |
| EP | 3279580 | B1 | 9/2022 |
| EP | 3869122 | B1 | 11/2022 |
| EP | 4160101 | A1 | 4/2023 |
| ES | 2804267 | T3 | 2/2021 |
| FR | 3102237 | A1 | 4/2021 |
| FR | 3111418 | A1 | 12/2021 |
| JP | 2002092714 | A | 3/2002 |
| JP | 2002263445 | A | 9/2002 |
| JP | 2007127316 | A | 5/2007 |
| JP | 2010210129 | A | 9/2010 |
| JP | 2014035171 | A | 11/2014 |
| JP | 6466219 | B2 | 2/2019 |
| JP | 6528446 | B2 | 6/2019 |
| JP | WO2019016959 | A1 | 7/2019 |
| JP | 6557329 | B2 | 8/2019 |
| JP | 6628833 | B2 | 1/2020 |
| JP | 6656363 | B2 | 3/2020 |
| JP | 6701337 | B2 | 5/2020 |
| JP | 2020515850 | A | 5/2020 |
| JP | 6766638 | B2 | 10/2020 |
| JP | 6766639 | B2 | 10/2020 |
| JP | 2020169798 | A | 10/2020 |
| JP | 6779355 | B2 | 11/2020 |
| JP | 2020183829 | A | 11/2020 |
| JP | 2021075076 | A | 5/2021 |
| JP | 6931093 | B2 | 9/2021 |
| JP | 2021131182 | A | 9/2021 |
| JP | 2021131194 | A | 9/2021 |
| JP | 2021131200 | A | 9/2021 |
| JP | WO2020194490 | A1 | 11/2021 |
| KR | 20190009713 | A | 1/2019 |
| KR | 20190058448 | A | 5/2019 |
| KR | 20210001769 | A | 1/2021 |
| KR | 20210042970 | A | 4/2021 |
| MX | 2019011319 | A | 3/2016 |
| RU | 2720037 | C2 | 4/2020 |
| WO | 2010007448 | A1 | 1/2010 |
| WO | 2014160831 | A1 | 10/2014 |
| WO | 2017002215 | A1 | 1/2017 |
| WO | 2021260588 | A1 | 12/2021 |
| WO | 2022244177 | A1 | 11/2022 |
| WO | 2022264368 | A1 | 12/2022 |

* cited by examiner

CLIMATE CONTROL SYSTEM WITH IMPROVED LEAK DETECTOR

TECHNOLOGICAL FIELD

The present disclosure relates generally to improved climate control systems that include features for detecting a refrigerant leak, particularly for climate control systems that include multi-pose heating, ventilation, or air conditioning (HVAC) units.

BACKGROUND

Climate control systems may generally be used in residential and/or commercial areas for heating and/or cooling to create comfortable temperatures inside those areas. As part of these systems, refrigerant is used to absorb/discharge heat from conditioned air to provide conditioning to a conditioned space.

While this refrigerant provides various benefits, including allowing for the exchange of thermal energy between the various components within the system, it can also be harmful if not appropriately contained and accounted for. The potential harms vary based on the type of refrigerant utilized in the climate control system, however, in general a refrigerant leak could be hazardous to property and/or occupants.

Existing leak detection concepts struggle to account for the various orientations at which a climate control system may be installed, and thus they are often overdesigned and/or prove ineffective once the overall system is installed. Therefore, there exists a need for an improved leak detection device and method, ideally one which enables efficient installation of a refrigerant leak detection system and its corresponding climate control system.

BRIEF SUMMARY

Examples of the present disclosure relate generally to climate control systems with improved leak detection. In these examples, the climate control system may include one or more of the following components: a heat exchanger, a drain pan, a refrigerant leak sensor, and control circuitry. The heat exchanger may be coupled to a closed circuit of the climate control system, and the closed circuit may route a refrigerant fluid within the climate control system. The heat exchanger may also route different fluids to exchange thermal energy between these fluids. For example, the heat exchanger may be configured to exchange thermal energy between a conditioned airflow and the refrigerant fluid.

In some examples, the drain pan may collect condensate produced at the heat exchanger, and the drain pan may be arranged to collect this condensate. The drain pan may include a bottom surface and one or more drains, which may route the condensate out of the drain pan.

In some examples, the refrigerant leak sensor detects refrigerant located outside the closed circuit, and in some examples, the refrigerant leak sensor is coupled to the drain pan. The refrigerant leak sensor may be positioned at various locations relative to features on the drain pan and/or the climate control system. For example, the refrigerant leak sensor may be located above the one or more drains, potentially by a certain distance. In some examples the refrigerant leak sensor may be located above a spillover wall of the drain pan.

The climate control system may also include control circuitry, which may be in the form of one or more controllers. The control circuitry may be operably coupled to various features associated with the climate control system for receiving information/signals, processing information, and/or operating components associated with the control circuitry. For example, the control circuitry may receive a signal from the refrigerant leak sensor indicative of refrigerant located outside the closed circuit. In some examples, the control circuitry may also determine a refrigerant leak has occurred based on the signal and/or perform additional functionality. These components and others are discussed in greater details herein.

The present disclosure thus includes, without limitation, the following examples.

Some examples provide a climate control system comprising: a heat exchanger coupled to a closed circuit of the climate control system for routing a refrigerant fluid, the heat exchanger being configured to exchange thermal energy between a conditioned airflow and the refrigerant fluid; one or more drain pans, at least one drain arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane; a refrigerant leak sensor coupled to the at least one drain pan and positioned a first distance along an axis normal to the first and second planes, the first distance measured as the distance from the refrigerant sensor to the first plane and sized such that the first distance is greater than or equal to a second distance measured along the axis from the first plane to the second plane, the refrigerant leak sensor configured to detect refrigerant located outside the closed circuit; and control circuitry operably coupled to the refrigerant leak sensor, the control circuitry configured to: receive a signal from the refrigerant leak sensor indicative of refrigerant located outside the closed circuit, and determine a refrigerant leak has occurred based on the signal.

Some examples provide an air handler unit comprising: a housing, the housing including: a fan configured to circulate a conditioned airflow through a heat exchanger and into a conditioned space; the heat exchanger coupled to a closed circuit of the climate control system for routing a refrigerant fluid, the heat exchanger being configured to exchange thermal energy between the conditioned airflow and the refrigerant fluid; one or more drain pans, at least one drain pan arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane; and a refrigerant leak sensor coupled to the at least one drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, the refrigerant leak sensor configured to detect refrigerant located outside the closed circuit.

Some examples provide a method for installing an air handler unit at a location, the air handler unit including a housing including a fan configured to circulate a conditioned airflow through a heat exchanger and into a conditioned space, the heat exchanger coupled to a closed circuit of the climate control system for routing a refrigerant fluid, one or more drain pans configured to collect condensate produced at a heat exchanger, and a refrigerant leak sensor configured to detect refrigerant located outside the closed circuit, the method comprising: orienting the air handler unit at the location in one of a plurality of orientation such that the fan is in fluid communication with a return air path and a supply air path associated with the conditioned space; locating the at least one drain pan to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane; positioning the refrigerant leak sensor a first distance along an axis normal to the first and second planes, the first distance measured as the distance from the refrigerant leak sensor to the first plane and sized such that the first distance is greater than or equal to a second distance measured along the axis from the first plane to the second plane; coupling the refrigerant leak sensor to the at least one drain pan; and connecting the refrigerant leak sensor to control circuitry.

These and other features, aspects, and advantages of the disclosure will be apparent from a reading of the following detailed description together with the accompanying drawings, which are briefly described below. The disclosure includes any combination of two, three, four, or more of the above-noted examples as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects and examples, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

Figure 5A:
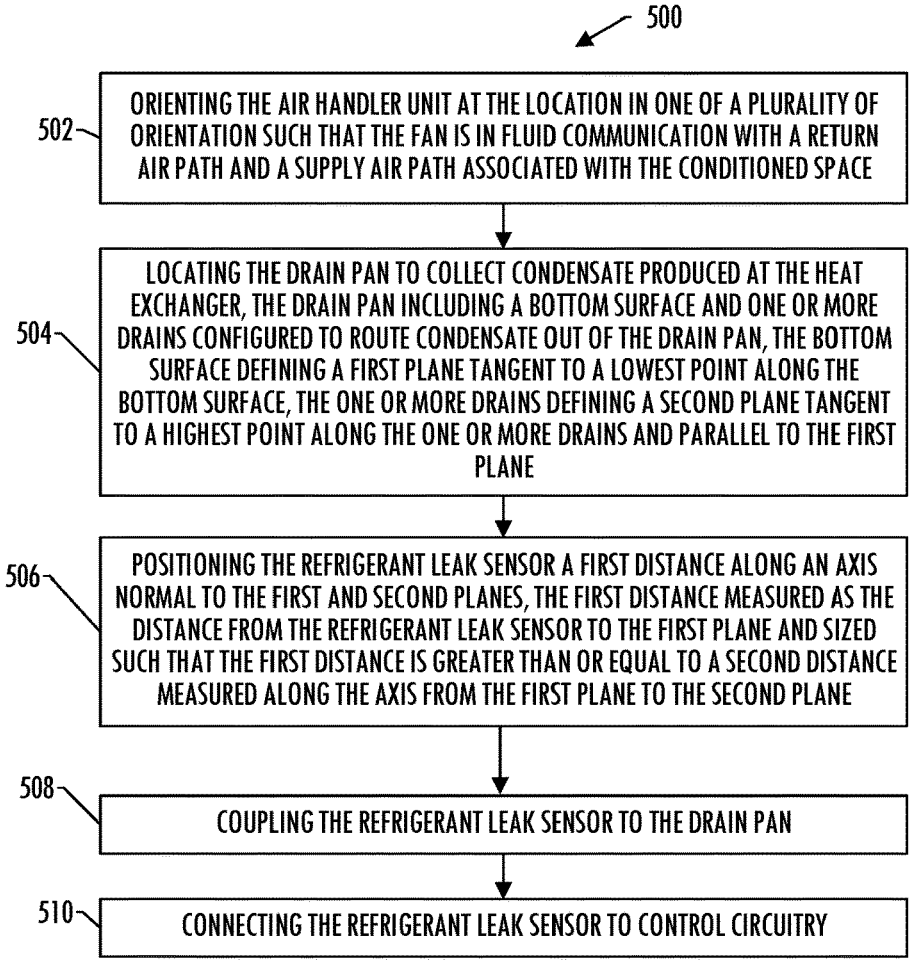
Figure 5B:
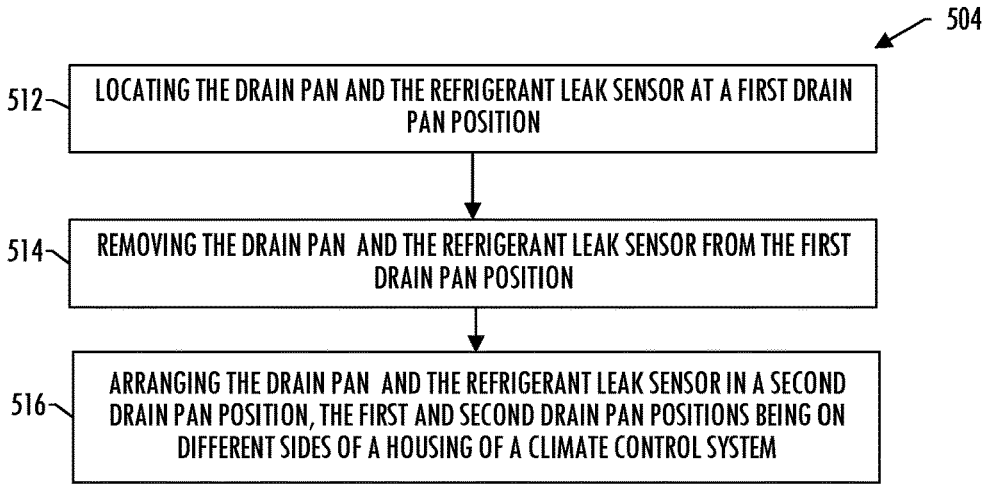
Figure 5C:
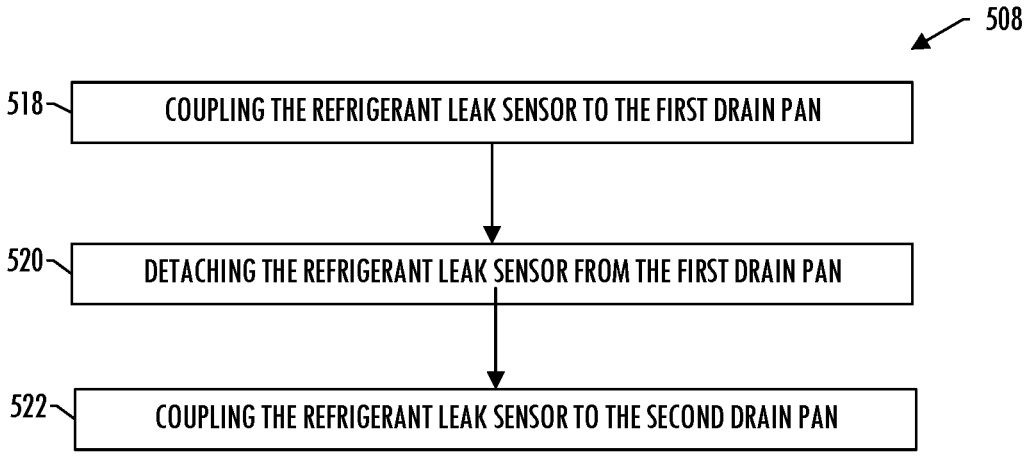
Figure 5D:
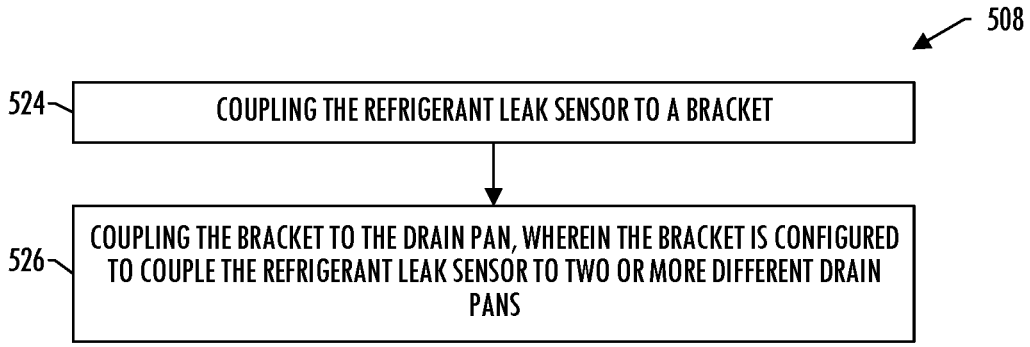
Figure 5E:
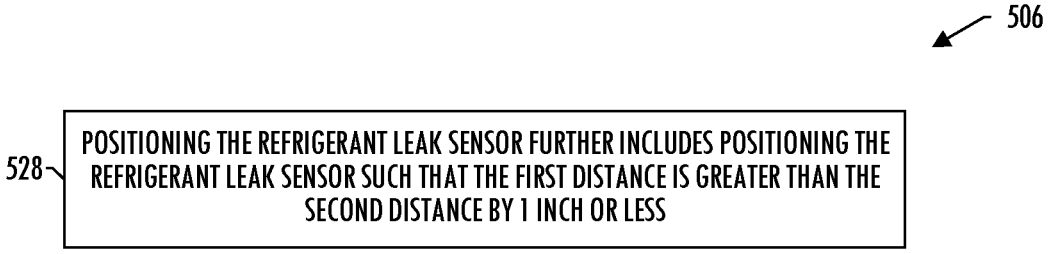
Figure 5F:
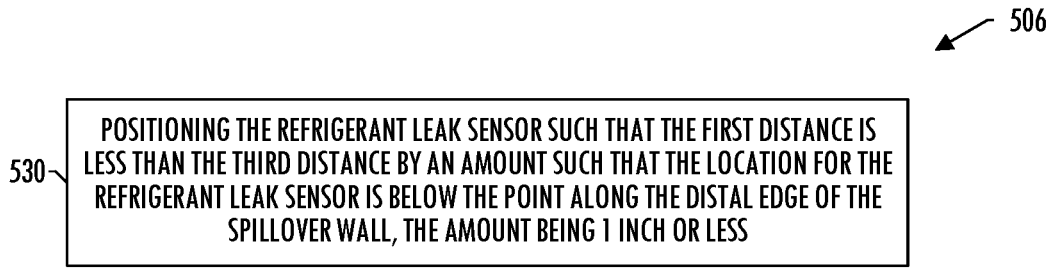
Figure 5G:
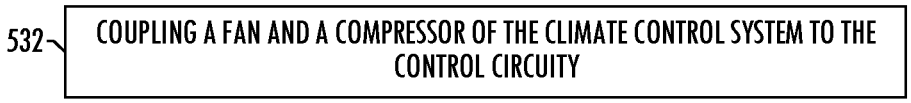
Figure 5H:
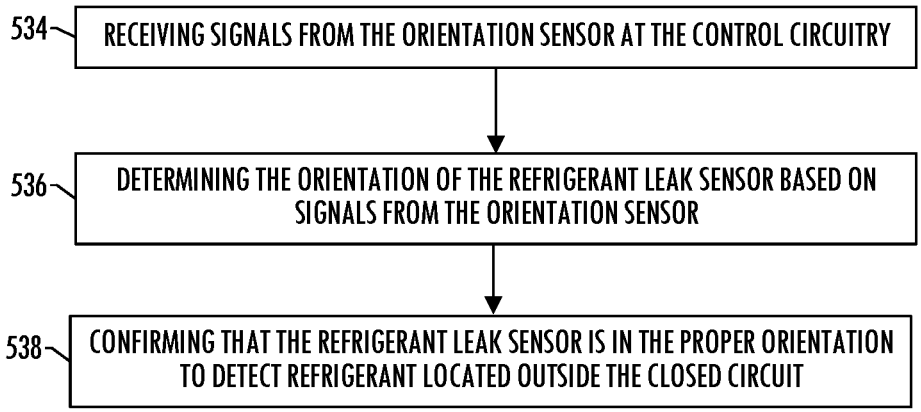
Figure 6:
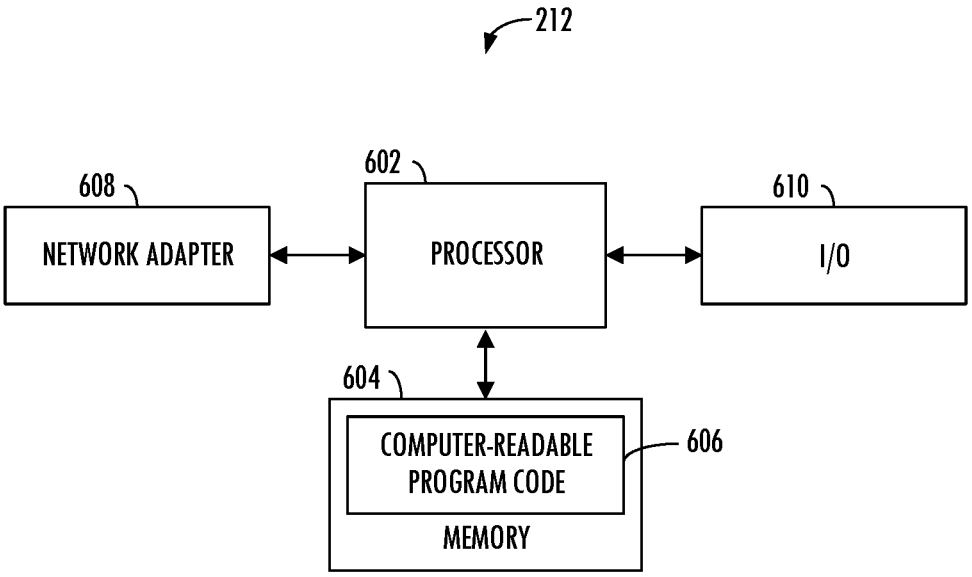

FIGS. 5A, 5B, 5C, 5D, 5E, 5F, 5G, and 5H are flowcharts illustrating various operations in a method of operating a climate control system, according to some example implementations; and FIG. 6 is an illustration of control circuitry, according to an example of the present disclosure.

DETAILED DESCRIPTION

Some examples of the present disclosure will now be described more fully hereinafter with reference to the accompanying figures, in which some, but not all examples of the disclosure are shown. Indeed, various examples of the disclosure may be embodied in many different forms and should not be construed as limited to the examples set forth herein; rather, these examples are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of examples of the described disclosure. It is understood that such terms are not used in any absolute sense.

Examples of the present disclosure relate generally to climate control systems with improved leak detection. In these examples, the climate control system may include one or more of the following components: a heat exchanger, a drain pan, a refrigerant leak sensor, and control circuitry. The heat exchanger may be coupled to a closed circuit of the climate control system, and the closed circuit may route a refrigerant fluid within the climate control system. The heat exchanger may also route different fluids to exchange thermal energy between these fluids. For example, the heat exchanger may be configured to exchange thermal energy between a conditioned airflow and the refrigerant fluid.

In some examples, the drain pan may collect condensate produced at the heat exchanger, and the drain pan may be arranged to collect this condensate. The drain pan may include a bottom surface and one or more drains, which may route the condensate out of the drain pan.

In some examples, the refrigerant leak sensor detects refrigerant located outside the closed circuit, and in some examples, the refrigerant leak sensor is coupled to the drain pan. The refrigerant leak sensor may be positioned at various locations relative to features on the drain pan and/or the climate control system. For example, the refrigerant leak sensor may be located above the one or more drains, potentially by a certain distance. In some examples the refrigerant leak sensor may be located above a spillover wall of the drain pan.

The climate control system may also include control circuitry, which may be in the form of one or more controllers. The control circuitry may be operably coupled to various features associated with the climate control system for receiving information/signals, processing information, and/or operating components associated with the control circuitry. For example, the control circuitry may receive a signal from the refrigerant leak sensor indicative of refrigerant located outside the closed circuit. In some examples, the control circuitry may also determine a refrigerant leak has occurred based on the signal and/or perform additional functionality. These components and others are discussed in greater details herein.

Figure 1:
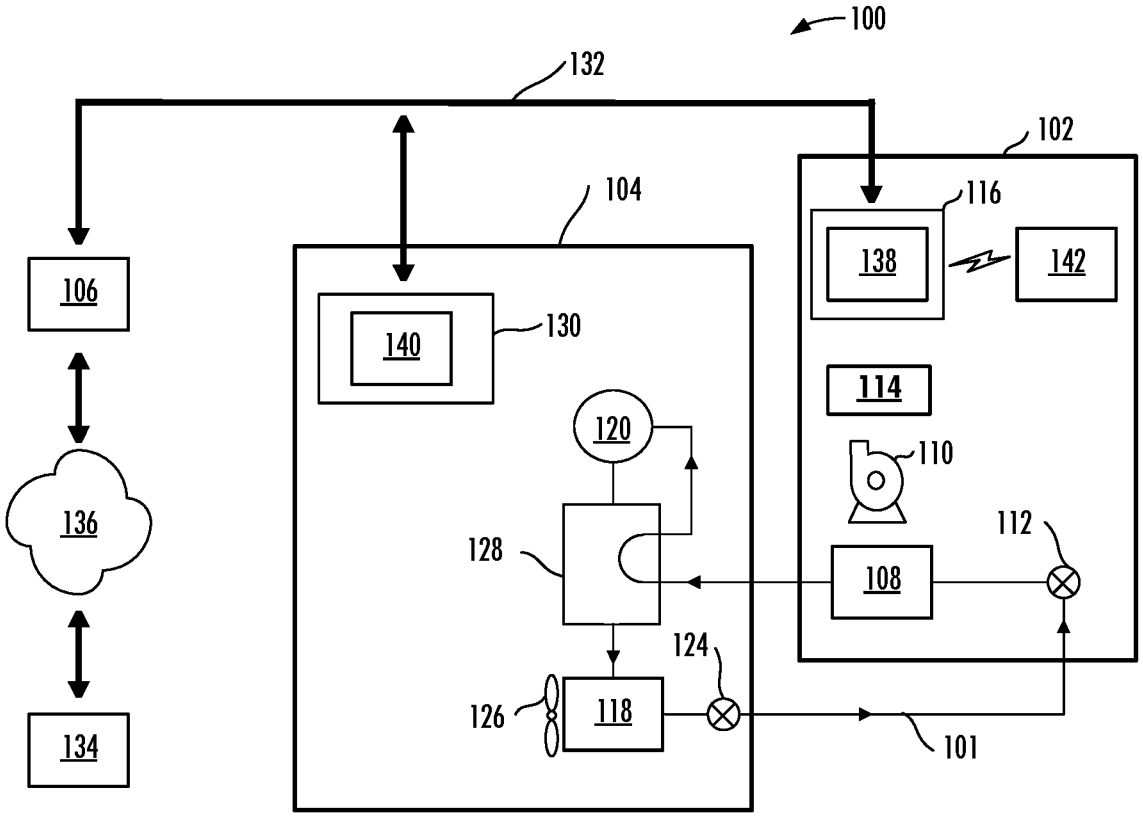
FIG. 1 is a schematic of a climate control system, according to an example of the present disclosure.

FIG. 1 shows a schematic diagram of a typical climate control system 100. In some examples, the climate control system 100 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The example depicted in FIG. 1 is configured in a cooling mode. The climate control system 100, in some examples is configured as a split system heat pump system, and generally comprises an indoor unit 102, an outdoor unit 104, and a system controller 106 that may generally control operation of the indoor unit 102 and/or the outdoor unit 104. The climate control system may also be configured as a packaged unit where the components of the indoor unit and the outdoor unit are included within a single unit. Other configurations are also contemplated within the scope of this disclosure.

As shown in FIG. 1, the climate control system 100 includes a closed circuit 101 that routes a refrigerant fluid between various components of the climate control system. The closed circuit may engage with these components to exchange thermal energy, potentially to address a thermal load. In some examples, the closed circuit may adjust the flow of refrigerant between the cooling mode and the heating mode.

Indoor unit 102 generally may comprise one or more of the following: an indoor air handling unit comprising an indoor heat exchanger 108, an indoor fan 110, an indoor metering device 112, a reheat unit 114, and an indoor controller 116. The indoor heat exchanger 108 may generally be configured to promote heat exchange between a refrigerant fluid carried within internal passages of the indoor heat exchanger 108 and an airflow that may contact the indoor heat exchanger 108 but that is segregated from the refrigerant. For example, the indoor heat exchanger may be coupled to the closed circuit 101, potentially via the internal passages of the indoor heat exchanger, and it may exchange thermal energy between the refrigerant fluid and the airflow.

The indoor metering device 112 may generally comprise an electronically-controlled motor-driven electronic expansion valve (EEV). In some examples, however, the indoor metering device 112 may comprise a thermostatic expansion valve, a capillary tube assembly, and/or any other suitable metering device.

The reheat unit 114 may comprise a heating element, potentially a gas or electric heating element. In some examples, the reheat unit 114 can heat an airflow to provide heating to a conditioned space. In some examples, the reheat unit 114 operates during defrost mode to reheat an airflow after it has been passed through the indoor heat exchanger 108 in the defrost mode.

Outdoor unit 104 generally comprises an outdoor heat exchanger 118, a compressor 120, an outdoor fan 126, an outdoor metering device 124, a switch over valve 128, and an outdoor controller 130. The outdoor heat exchanger 118 may generally be configured to promote heat transfer between a refrigerant fluid carried within internal passages of the outdoor heat exchanger 118 and an airflow that contacts the outdoor heat exchanger 118 but is segregated from the refrigerant. For example, the outdoor heat exchanger may be coupled to the closed circuit 101, potentially via the internal passages of the outdoor heat exchanger, and it may exchange thermal energy between the refrigerant fluid and the airflow.

The outdoor metering device 124 may generally comprise a thermostatic expansion valve. In some examples, however, the outdoor metering device 124 may comprise an electronically-controlled motor driven EEV similar to indoor metering device 112, a capillary tube assembly, and/or any other suitable metering device.

In some examples, the switch over valve 128 may generally comprise a four-way reversing valve. The switch over valve 128 may also comprise an electrical solenoid, relay, and/or other device configured to selectively move a component of the switch over valve 128 between operational positions to alter the flow path of refrigerant through the switch over valve 128 and consequently the closed circuit 101 in the climate control system 100. Additionally, the switch over valve 128 may also be selectively controlled by the system controller 106, an outdoor controller 130, and/or the indoor controller 116.

The system controller 106 may generally be configured to selectively communicate with the indoor controller 116 of the indoor unit 102, the outdoor controller 130 of the outdoor unit 104, and/or other components of the climate control system 100. In some examples, the system controller 106 may be configured to control operation of the indoor unit 102, and/or the outdoor unit 104. In some examples, the system controller 106 may be configured to monitor and/or communicate with a plurality of temperature sensors associated with components of the indoor unit 102, the outdoor unit 104, and/or the outdoor ambient temperature. Additionally, in some examples, the system controller 106 may comprise a temperature sensor and/or may further be configured to control heating and/or cooling of conditioned spaces or zones associated with the climate control system 100. In other examples, the system controller 106 may be configured as a thermostat for controlling the supply of conditioned air to zones associated with the climate control 100, and in some examples, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the climate control system 100 and may receive user inputs related to operation of the climate control system 100. However, the system controller 106 may further be operable to display information and receive user inputs tangentially related and/or unrelated to operation of the climate control system 100. In some examples, the system controller 106 may not comprise a display and may derive all information from inputs that come from remote sensors and remote configuration tools.

In some examples, the system controller 106 may be configured for selective bidirectional communication over a communication bus 132, which may utilize any type of communication network (e.g., a controller area network (CAN) messaging, etc.). In some examples, portions of the communication bus 132 may comprise a three-wire connection suitable for communicating messages between the system controller 106 and one or more of the components of the climate control system 100 configured for interfacing with the communication bus 132. Still further, the system controller 106 may be configured to selectively communicate with components of the climate control system 100 and/or any other device 134 via a communication network 136. In some examples, the communication network 136 may comprise a telephone network, and the other device 134 may comprise a telephone. In some examples, the communication network 136 may comprise the Internet, and the other device 134 may comprise a smartphone and/or other Internet-enabled mobile telecommunication device.

The indoor controller 116 may be carried by the indoor unit 102 and may generally be configured to receive information inputs, transmit information outputs, and/or otherwise communicate with the system controller 106, the outdoor controller 130, and/or any other device 134 via the communication bus 132 and/or any other suitable medium of communication. In some examples, the indoor controller 116 may be configured to communicate with an indoor personality module 138 that may comprise information related to the identification and/or operation of the indoor unit 102.

The indoor EEV controller 142 may be configured to receive information regarding temperatures and/or pressures of the refrigerant in the indoor unit 102. More specifically, the indoor EEV controller 142 may be configured to receive information regarding temperatures and pressures of refrigerant entering, exiting, and/or within the indoor heat exchanger 108.

The outdoor controller 130 may be carried by the outdoor unit 104 and may be configured to receive information inputs, transmit information outputs, and/or otherwise communicate with the system controller 106, the indoor controller 116, and/or any other device 134 via the communication bus 132 and/or any other suitable medium of communication. In some examples, the outdoor controller 130 may be configured to communicate with an outdoor personality module 140 that may comprise information related to the identification and/or operation of the outdoor unit 104. In some examples, the outdoor controller 130 may be configured to receive information related to an ambient temperature associated with the outdoor unit 104, information related to a temperature of the outdoor heat exchanger 118, and/or information related to refrigerant temperatures and/or pressures of refrigerant entering, exiting, and/or within the outdoor heat exchanger 118 and/or the compressor 120.

As discussed in more detail below, the control circuitry 212 (see FIG. 5) may include some or all of the system controller 106, the indoor controller 116, and the outdoor controller 130, and the control circuitry 212 may control the various devices and components associated with the climate control system 100.

FIGS. 2A, 2B, 2C, and 2D show illustrations of example air handler units 200A and 200B, which may be part of the climate control system 100. In some examples, the air handler unit may be the same or substantially the same as the indoor unit 102. In the depicted examples, both air handler units 200 (A and B) include a housing 202, and within the housing a fan 204, a heat exchanger 206, a drain pan 208, and a refrigerant leak sensor 210. In some examples, including the depicted examples, the air handler unit further includes control circuitry 212. Other air handlers may include more or less of components. For example, the fan 204 may be outside of the housing 202. In these examples, where the fan is located outside of the housing, the air handler unit may be a cased coil assembly where the cased coil assembly includes a housing that encloses the heat exchanger with the associated heat exchanger conditioning coils, and the cased coil assembly may also include the drain pan. In some examples, the cased coil assemblies are associated with, and/or coupled to, a furnace unit (not shown). For example, the cased coil assembly may be located above or below the furnace unit in a vertical orientation, or in a similar horizontal arrangement where the cased coil assembly is upstream or downstream from the furnace unit. In some of these examples, the furnace unit may include a circulation fan, e.g., fan 204, which circulates conditioned air through both the furnace unit and the cased coil assembly. In other examples, the circulation fan is located outside both the furnace unit and the cased coils. Regardless, in some examples, the refrigerant leak sensor may be coupled to the drain pan in the cased coil assembly in the same manner as the examples discussed herein, e.g., the air handler examples, etc.

Figure 2A:
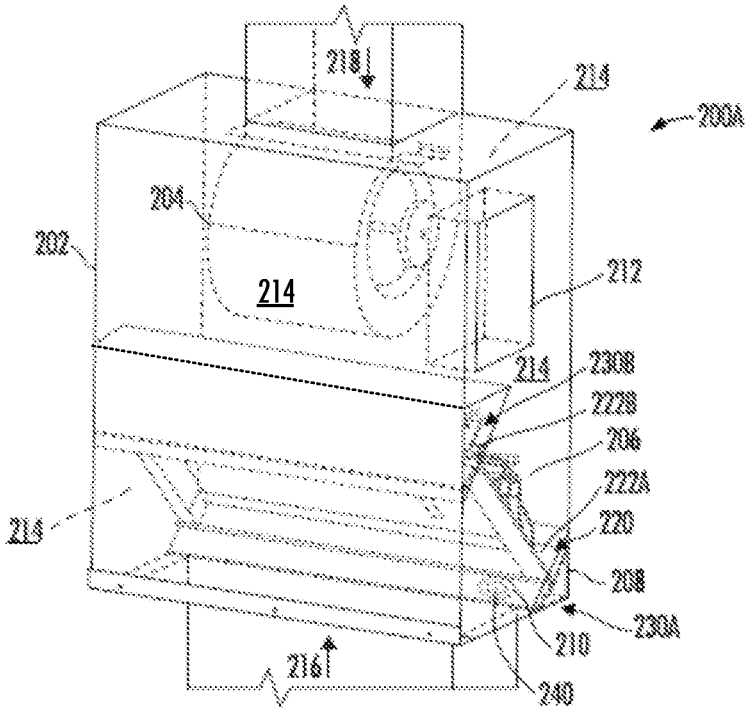
FIG. 2A illustrates an example of an air handler unit for a climate control system in a vertical orientation according to some examples of the present disclosure.
Figure 2B:
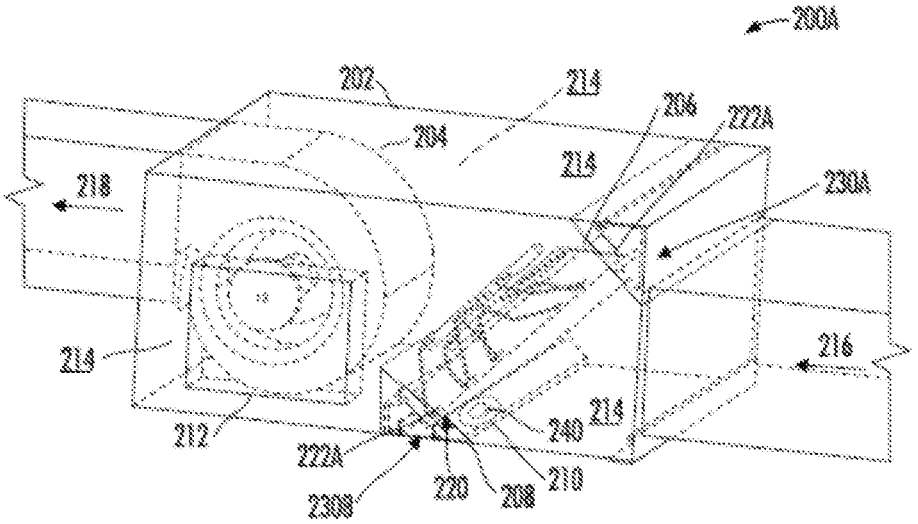
FIG. 2B illustrates an example of an air handler unit for a climate control system in a horizontal orientation according to some examples of the present disclosure.
Figure 2C:
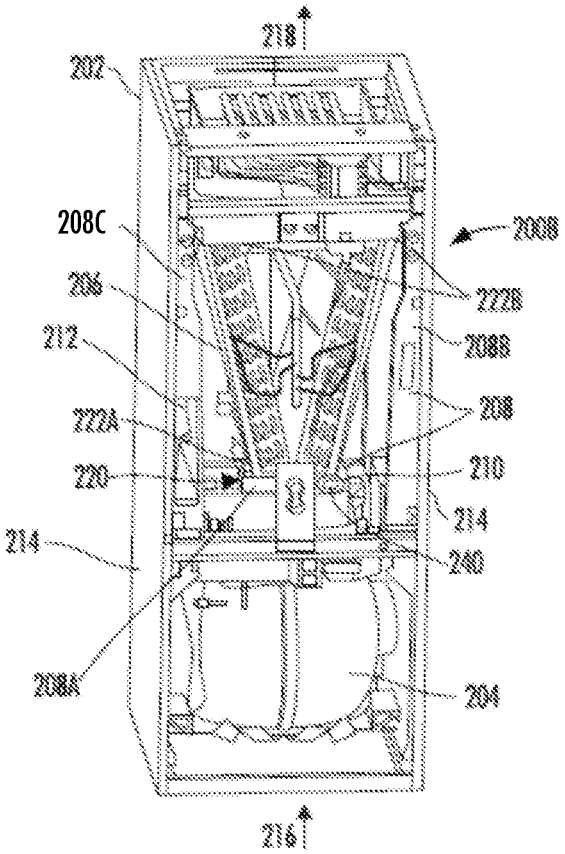
FIG. 2C illustrates an example of an air handler unit for a climate control system in a vertical orientation according to some examples of the present disclosure.
Figure 2D:
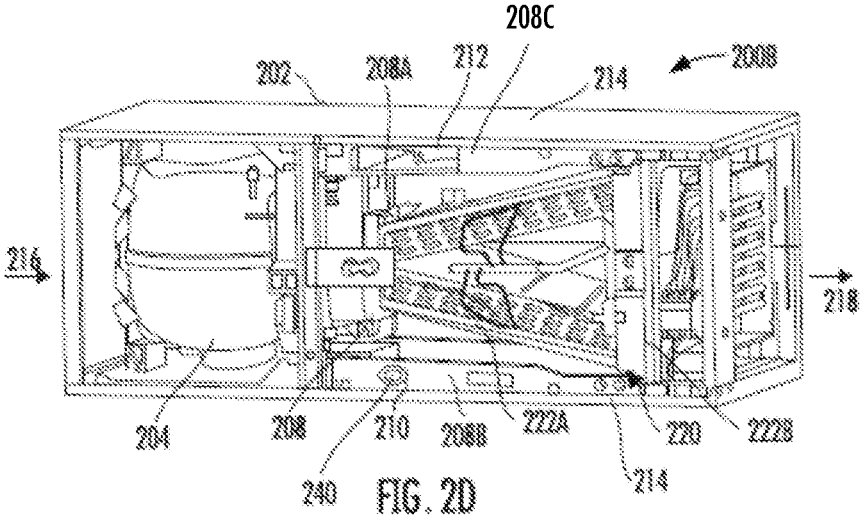
FIG. 2D illustrates an example of an air handler unit for a climate control system in a horizontal orientation according to some examples of the present disclosure.

As shown in these figures the air handler unit 200 may be positioned at multiple different orientations, and these orientations may impact the drain pan 208 location and/or configuration. For example, FIGS. 2A and 2B show illustrations of the same air handler unit 200A in different orientations. In these depicted examples, the air handler unit 200A includes a drain pan 208 that may move between locations and to different walls 214 within the housing 202. FIG. 2A may be considered a vertical orientation because the fan 204 and the heat exchanger 206 are aligned vertically relative to each other, and FIG. 2B may be considered a horizontal orientation because the fan 204 and the heat exchanger 206 are aligned horizontal to each other. FIGS. 2C and 2D show illustrations of a different example of air handler unit 200B, and in this example, the air handler unit has at least two drain pans 208A and 208B. The depicted example further includes a third drain pan 208C. These figures also show the air handler unit 200B in two different orientations, where FIG. 2C is the vertical orientation and 2D is the horizontal orientation. In some examples, the air handler unit is the same or substantially the same as the design(s) discussed in U.S. Pat. No. 10,139,115 entitled "Air handling unit with inner wall space," which is hereby incorporated by reference in its entirety.

In some examples, the fan 204 is the same or substantially the same as the indoor fan 110. The fan 204 may circulate conditioned airflow through the heat exchanger 206 and into the conditioned space. The fan 204 may be any convention fan or blower as described above with respect to the indoor fan 110 or outdoor fan 126. For example, the fan 204 may be a fixed speed fan, a variable speed fan, and/or a staged fan, which may include multiple fans. In some examples, the fan 204 circulates conditioned airflow through the heat exchanger 206 and into the conditioned space. In these examples, the conditioned airflow may be routed to the fan 204 through a return air path 216. The conditioned airflow may also be routed to the conditioned space through a supply air path 218. The return air path and the supply air path may include any conventional structure for routing conditioned air, e.g., a ducted, plenums, registers, etc.

In some examples, heat exchanger 206 is the same or substantially the same as the indoor heat exchanger 108. For example, heat exchanger 206 may be configured to exchange thermal energy between a conditioned airflow and the refrigerant fluid. In these examples, the heat exchanger may be coupled to a closed circuit 101 of the climate control system 100, and the closed circuit may route the refrigerant fluid within the climate control system to various components.

Returning to FIG. 1, an example of the closed circuit 101 is shown along with how it may be coupled to a heat exchanger. As shown in FIG. 1 and discussed above, the closed circuit routes refrigerant fluid between various components of the climate control system 100. As shown in that figure, one or more heat exchangers (e.g., indoor heat exchanger 108 and outdoor heat exchanger 118) may be coupled to the closed circuit. The heat exchanger 206 in air handler unit 200A and 200B shown in FIGS. 2A-D may be coupled in a similar matter.

As shown in these figures, e.g., FIGS. 2A-D, the heat exchanger 206 may also be in fluid communication with a conditioned airflow, which may be circulated by fan 204. As a result, thermal energy may be exchanged between the conditioned airflow and the refrigerant fluid at the heat exchanger 206. This thermal energy exchange may result in fluids within the conditioned airflow condensing at the heat exchanger to produce condensate. For example, water vapor may be included in the conditioned airflow, and as the airflow is conditioned at a heat exchanger the water vapor may condense, producing condensate at the heat exchanger. Other forms of condensate or methods of producing condensate may also occur.

In some examples, the drain pan 208 is arranged to collect condensate produced at the heat exchanger 206. As shown in FIGS. 2A and 2B, the drain pan may be arranged near a lower section of the air handler unit 200A proximate a lower end 220 of the heat exchanger 206. The lower end may be defined relative to the orientation of the heat exchanger. For example, the heat exchanger in the example depicted in FIGS. 2A and 2B includes at least two ends, 222A and 222B. The lower end 220 will be the end that is oriented at the lower portion of the heat exchanger relative to the ground at a given orientation. As a result, in FIG. 2A end 222A is considered the lower end 220 at this orientation, and in FIG. 2B end 222B is considered the lower end 220 at that orientation.

In some examples, the drain pan 208 is coupled to an end 222 of the heat exchanger 206, and in other examples, the drain pan is located a distance below the heat exchanger. The drain pan may also extend along an entire cross-section of the heat exchanger or be otherwise sized to collect condensate. As also shown in FIGS. 2A-D, the orientation of the air handler unit may change, but at least one drain pan continues to be arranged to collect condensate produced at the heat exchanger.

FIGS. 2A and 2B shows an example where the drain pan 208 may be moved between different locations within the housing 202, which may be necessary and/or desirable when the air handler unit 200A changes orientations. In these examples, the housing 202 may include a first drain pan position 230A and a second drain pan position 230B. Each of these drain pan positions may be designed to support the drain pan, and may be specifically located to support the drain pan in a given orientation of the air handler unit. For example, as shown in the depicted example, these drain pan positions are each located proximate an end 222 of the heat exchanger 206. In addition, depending on the orientation of the air handler unit, each of the drain pan positions are located such that the drain pan will be under the heat exchanger, and in these examples, the drain pan would be arranged to be under a lower end 220 of the heat exchanger in a given orientation. For example, when the air handler unit is in the orientation shown in FIG. 2A, the first drain pan position 230A locates the drain pan such that it is proximate end 222A of the heat exchanger 206, which is the lower end 220 in that orientation. Similarly, when the air handler unit is in the orientation shown in FIG. 2B, the second drain pan position 230B locates the drain pan such that it is proximate end 222B, which is the lower end 220 of the heat exchanger 206 in that orientation.

In some examples, the drain pan position 230 defines a location where drain pan 208 may be located such that it is arranged to collect condensate produced at the heat exchanger 206. In some examples, the drain pan positions may include additional features that may assist in locating and/or aligning the drain pan at the drain pan position.

FIGS. 2C and 2D show an example where the drain pan 208 in air handler unit 200B includes a first drain pan 208A and a second drain pan 208B. In the depicted example, the first and second drain pans are located within the housing 202 such that the first drain pan is active in a first orientation and inactive in a second orientation, and the second drain pan is active in the second orientation and inactive in the first orientation. For example, when the air handler unit is located in a vertical configuration as shown in FIG. 2C, the first drain pan is active such that it is arranged to collect condensate produced at heat exchanger 206. As shown, the first drain pan is located proximate the lower end 220 of the heat exchanger, which is end 222A in this orientation, e.g., the vertical orientation shown in FIG. 2C. The example in FIG. 2C also shows the second drain pan, which is inactive in this orientation. As shown, the second drain pan is located on a vertical side wall 214 and may not be arranged to collect condensate produced at the heat exchanger when the air handler is in this orientation.

The example shown in FIG. 2D shows an alternative orientation for air handler unit 200B where it is in a horizontal orientation. In this orientation, the second drain pan 208B is active such that it is arranged to collect condensate produced at the heat exchanger 206. As shown, the second drain pan is located under the heat exchanger in this orientation, e.g., horizontal orientation shown in FIG. 2D. As shown in this example, the second drain pan spans the horizontal cross section of the heat exchanger. The example in FIG. 2D also shows the first drain pan 208A, which is inactive in this orientation. As shown, the first drain pan is located vertically and may not be arranged to collect condensate produced at heat exchanger 206 in this location.

In other configurations, the drain pans may be located on different walls 214 of housing 202, potentially to account for various different horizontal orientations of the air handler. The example air hander unit depicted in FIGS. 2C and 2D further includes a third drain pan 208C. As shown, the third drain pan is inactive in the first and second orientations. In the depicted example, the third drain pan is active in a third orientation (not shown) where the air handler unit is oriented horizontally on the other side, e.g., oriented in the reverse of the orientation shown in FIG. 2D such that the third drain pan is located under the heat exchanger.

Figure 3A:
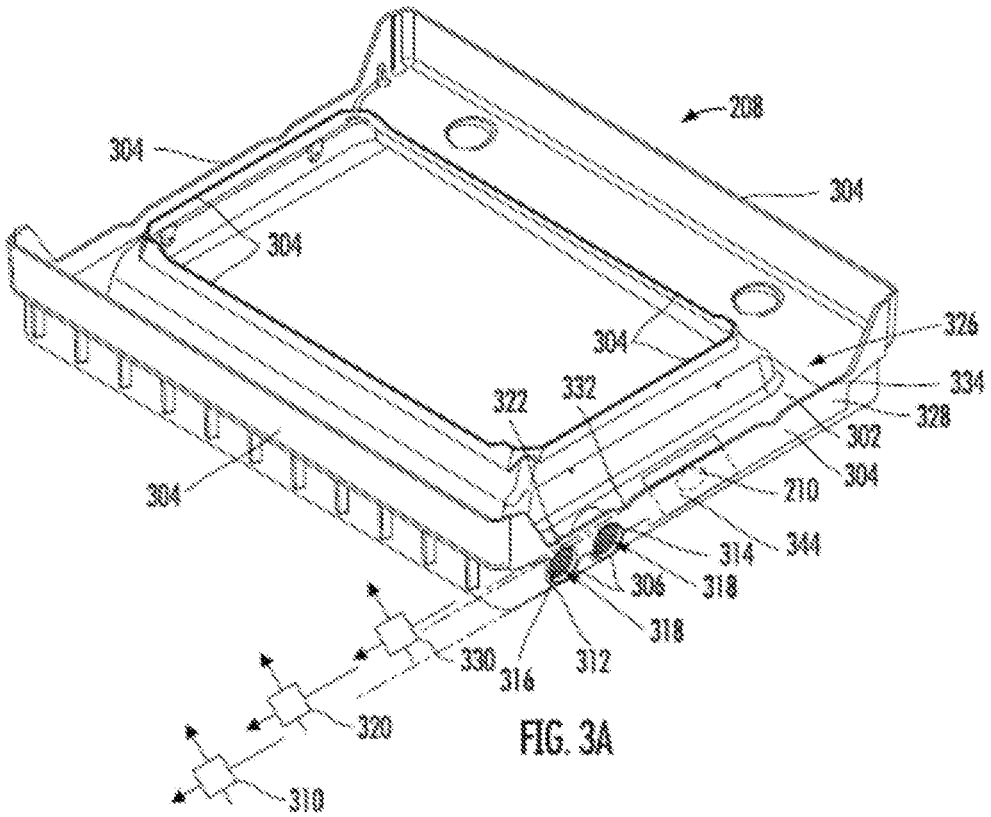
FIG. 3A illustrates an example of a drain pan according to some examples of the present disclosure.
Figure 3B:
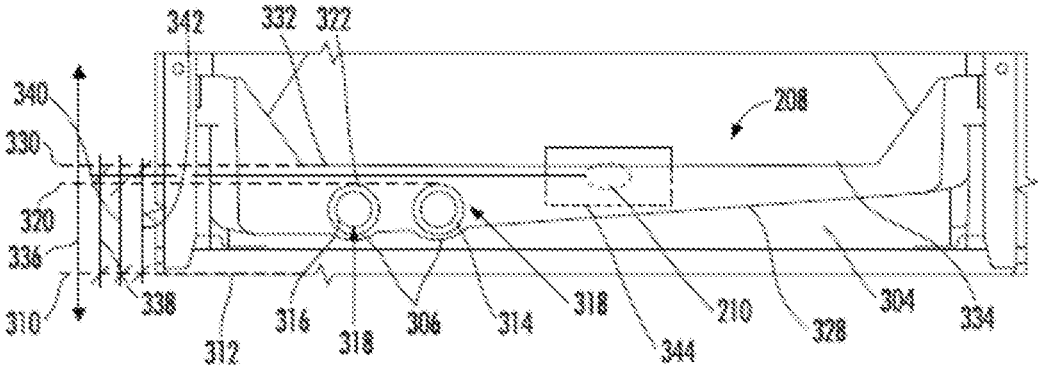
FIG. 3B illustrates an example of a drain pan according to some examples of the present disclosure.

FIGS. 3A and 3B show example illustrations of a drain pan 208. As shown in the depicted example, the drain pan may include a bottom surface 302, walls 304, and drains 306 along with potentially other features. The depicted examples also include a refrigerant leak sensor 210 coupled to the drain pan.

The bottom surface 302 may be the surface that collects condensate. In some examples, the bottom surface defines a first plane 310 tangent to a lowest point 312 along the bottom surface. The lowest point may generally be located at the lowest point on the drain pan 208 where condensate may be collected. In addition, in some examples, the first plane runs tangent to this point such that the first plane is general parallel to the plane defined by the surface on which the air handler unit 200 is installed, e.g., the first surface may be generally parallel with the ground. Thus, in some examples, the bottom surface may be flat, and in other examples, the bottom surface may include nonlinear features, e.g., curves, slants, depressions, etc. In these examples, the first plane is still oriented the same relative to the plane defined by the surface on which the air handler unit 200 is installed, this is because the tangent to the lowest point along the bottom surface is the same orientation regardless of the shape of the bottom surface.

The example drain pan 208 depicted in FIGS. 3A and 3B also includes drains 306. These drains may route the condensate collected at the drain pan out of the drain pan. For example, the drain(s) may be connected to pipes (not shown) that route the condensate out of the drain pan, typically in a desired direction. In the example depicted in FIG. 3, two drains are shown, a primary drain 314 and a secondary drain 316. The primary drain may be the drain arranged to route the condensate under normal operations, and the secondary drain may be arranged to route the condensate when the condensate produced at the heat exchanger increases above a normal level. In some examples, the secondary drain is arranged higher than the primary drain such that it only routes condensate when the level of condensate is high enough such that the condensate reaches the secondary drain.

Figure 3C:
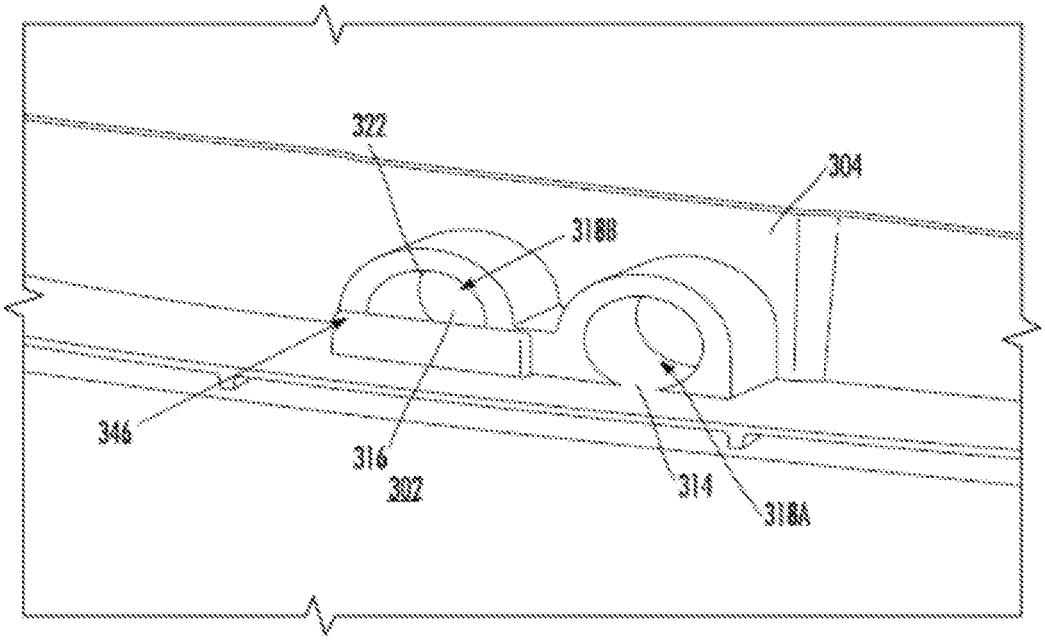
FIG. 3C illustrates an example of primary and secondary drain associated with a drain pan according to some examples of the present disclosure.

In the depicted examples, the primary drain 314 and the secondary drain 316 are each located along a wall 304, and in these examples the drains comprise an opening 318 in the wall. In other examples, the drain(s) may be located in the bottom surface or elsewhere within the drain pan 208. FIG. 3C shows a further example of these drains arranged along the outer wall 304 of the drain pan 208. The primary drain 314 includes an opening 318A and the secondary drain 316 includes an opening 318B. As shown in this example depiction, both openings 318 (A and B) extend the same vertical distance above the bottom surface, e.g., each have the same height; however, in the depicted examples, the opening 318A for the primary drain 314 begins at a lower point relative to the bottom surface. The opening 318B for the secondary drain 316 does not begin until approximately the middle section 346 of the opening 318A for the primary drain. As a result, in this design, the primary drain begins routing the condensate from the drain pan as the drain pan fills. Once the condensate rises to a level above the middle section 346 then the secondary drain may also engage to route condensate out of the drain pan, increasing the volume of flow out of the drain pan. This design may allow the secondary drain to only engage when the condensate flow into the drain pan is sufficiently high to require more than one drain to route the condensate out of the drain pan. Other designs may include more or less drains and/or may design them differently to control the flow of condensate collected in the drain pan out of the pan.

In some examples, the drains 306 may define a second plane 320. The second plane may be defined as the plane tangent to the highest point 322 along the one or more drains and parallel to the first plane 310. The highest point generally may be located at the highest point associated with the drain(s) that routes the condensate away from the drain pan 208. This point is typically the furthest point from the lowest point of the bottom surface 302. Similar, to the first plane, the second plane runs tangent to this point 322 such that the second plane will run parallel to the first plane, as well as the plane defined by the surface on which the air handler unit 200 is installed, e.g., the second surface is also generally parallel with the ground when the corresponding drain pan is active, regardless of the orientation of the drain(s) relative to the drain pan.

For example, in the examples depicted in FIGS. 3A-C, the drains 306, e.g., the primary drain 314 and the secondary drain 316, are located within a wall 304, and in this example, the highest point on the secondary drain is equivalent to the highest point on the primary drain, and thus the second plane 320 may be defined by either point. As shown in this example, the second plane extends from the highest point 322 on the secondary drain and runs parallel to the first plane 310. In other examples, the drains may be located in other orientations, however, the orientation of the second plane does not change. For example, the drain(s) may be associated with wall(s) that extent at an angle, or in other examples, the drain may be located on the bottom surface 302 or on other structures associated with the drain pan 208. In these examples the second plane is still oriented parallel to the first plane, and typically the ground. In examples where the drain is located at the lowest point 312 on the bottom surface, the first and second planes would typically be co-planer because the second plane generally would not be located lower than the first plane, e.g., the highest point on the drain for routing condensate out of the drain pan will typically not be lower than the lowest point on the bottom surface of the drain pan.

The depicted examples also include wall(s) 304. In the depicted example, the walls extend from the bottom surface 302, and some of these walls 304 extend substantially vertically from the bottom surface. These walls 304 may define a cavity 326 for containing fluid within the drain pan 208. This fluid may be refrigerant leaking out of the circuit, or it some examples it may be condensate, other fluids, or a mixture of fluids. In some examples one of these walls is considered the spillover wall 328, which may be considered the lowest wall associated with the cavity. In these examples, the spillover wall may be the wall in which the fluid, e.g., refrigerant, spills out of the drain pan if the drain(s) 306 are unable to adequately route the fluid out of the drain pan.

In some examples, the spillover wall 328 may define a third plane 330. The third plane may be defined as a closest plane parallel to the first plane 310 that is tangent to the corresponding point 332 along a distal edge 334 of the spillover wall. The point 332 is defined based on the relationship between the third plane and the first plane, and as a result, the height of the spillover wall may not be the only factor that determines the location of the point 332 (and the corresponding third plane). Rather, the point 332 along the distal edge 334 may generally be the lowest point on the spillover wall relative to the bottom surface 302, such that the point 332 may be the first location at which fluid would flow over the spillover wall. In addition, the third plane is tangent to this point 332 such that it runs parallel to the first and second planes (310 and 320) regardless of the orientation of the spillover wall. In addition, the third plane, also like the first and second planes, will typically run parallel to the plane defined by the surface on which the air handler unit 200 is installed, e.g., the third plane is generally parallel with the ground, regardless of the orientation of the spillover wall when the drain pan is in an active position.

In some examples, a refrigerant leak sensor 210 is coupled to the drain pan 208 and it may be positioned relative to features on the drain pan. For example, the refrigerant leak sensor may be positioned such that it is located above drain(s) 306. In these examples the refrigerant leak sensor may be positioned such that it is only a certain distance above the drains. In some examples, the refrigerant leak sensor may be positioned below the spillover wall 328. In these examples the refrigerant leak sensor may be located below the third plane 330, potentially below the point 332 along the distal edge 334. In some examples, the refrigerant leak sensor may be positioned below the spillover wall and above the drains. In some examples, the refrigerant leak sensor is below the spillover wall by a certain distance and/or above the drains by a certain distance. In these examples the refrigerant leak sensor may be only above the drains by a certain distance or less, while still being located below the spillover wall.

For example, the refrigerant leak sensor 210 may be positioned a distance along an axis 336 normal to the first and second planes (310 and 320). In these examples the axis may be used to define the distance of the refrigerant leak sensor to various features of the drain pan vertically. For example, in the depicted example the axis may be used to measure a distance 338, potentially a first distance, from the center of the refrigerant leak sensor to the first plane. This distance may provide a measurement for how far vertically the refrigerant leak sensor is located from the lowest point 312 in the bottom surface 302. Similarly, the axis may also be used to measure a distance 340, potentially a second distance, from the first plane to the second plane. The axis may also be used to measure a distance 342, potentially a third distance, from the first plane to the third plane 330. In other examples, other distances may be used, for example a distance from the center of the refrigerant leak sensor to the second or third planes along the axis. These other distances may be used to determine the refrigerant leak sensors position relative to the drain(s) or the spillover wall.

In some examples, the refrigerant leak sensor 210 is located vertically above the drains 306. In these examples, the reference sensor may be positioned such that the first distance 338 measured as the distance from the refrigerant leak sensor to the first plane 310 is sized such that the first distance is greater than or equal to a second distance 340 measured along the axis 336 from the first plane to the second plane 320.

In some examples, the refrigerant leak sensor 210 is positioned above the drain(s) 306 by a set distance. In some examples, this set distance may define a maximum distance vertically the refrigerant leak sensor may be positioned above the drain. For example, the first distance may be greater than the second distance 340 by an amount, potentially less than or equal to a given length, e.g., 1 inch. In other examples, the set distance may define a minimum distance in a similar manner.

In some examples, the refrigerant leak sensor 210 is positioned below the spillover wall 328. In these examples, the refrigerant leak sensor may be positioned such that the first distance 338 is a given length relative to the third distance 342. In these examples, the first distance may be sized such that it is less than the third distance. In some examples, the first distance is less than the third distance by a minimum or maximum distance. For example, the first distance is sized such that it is less than the third distance by 1 inch or less. In some examples, the first distance is sized such that it is greater than the third distance, and in these examples, the refrigerant leak sensor may be located above the spillover wall. Similarly, in these examples, the first distance may be sized to be greater than the third distance by a set amount, e.g., 1 inch.

In some examples, the first distance 338 is sized such that the refrigerant leak sensor is positioned relative to both the spillover wall and the drain(s) 306. For example, the refrigerant leak sensor may be positions such that it is located below the spillover wall, e.g., below the third plane 330, and above the drains, e.g., above the second plane 320, by a set distance. In these examples, the first distance may be sized such that it is greater than the second distance 340 and less than the third distance 342. In some examples, the first distance is sized relative to both of these planes, e.g., the first distance is greater than the second distance by 1 inch or less and the first distance is also less than the third distance by 1 inch or less. The drain may be also be positioned in other manners relative to these components and defined planes.

The refrigerant leak sensor 210 may be coupled to drain pan 208 in various different ways. For example, the refrigerant leak sensor may be coupled to the drain pan using fasteners, adhesives, clips, or other features. In some examples, the refrigerant leak sensor is coupled to the drain pan using a bracket 344. In some examples, the bracket allows the refrigerant leak sensor to be coupled to two or more different drain pans. In some examples, the bracket allows the refrigerant leak sensor to be coupled to two or more positions within the drain pan. In some examples, the bracket includes features that aligns the refrigerant leak sensor at the appropriate location on the drain pan. In some examples, the bracket includes multiple alignment features that appropriately locate the refrigerant leak sensor on multiple different drain pans and/or appropriately locate the refrigerant leak sensor at multiple different positions on a given drain pan.

Figure 4A:
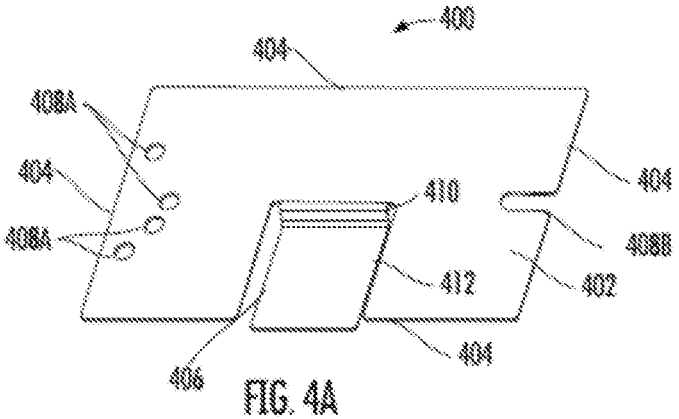
FIG. 4A illustrates an example of a bracket according to some examples of the present disclosure.
Figure 4B:
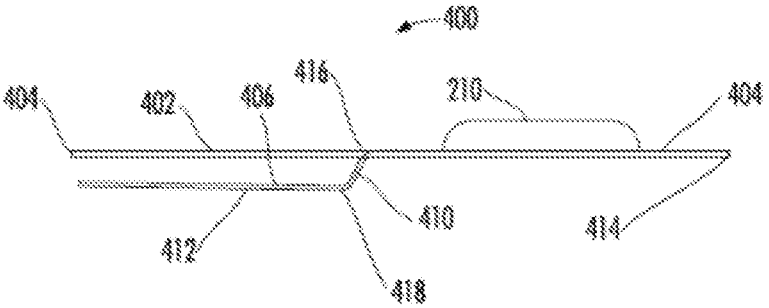
FIG. 4B illustrates an example of a bracket according to some examples of the present disclosure.
Figure 4C:
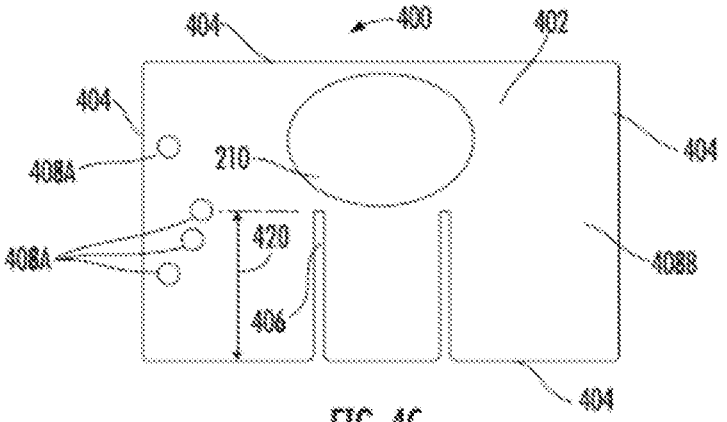
FIG. 4C illustrates an example of a bracket according to some examples of the present disclosure.

FIGS. 4A, 4B, and 4C show an illustration of an example bracket 400 that may be used. In some examples, bracket 400 is the same or similar to bracket 344. The example bracket 400 includes a surface 402 and edges 404. The bracket further includes an extended arm 406 and fastener alignment openings 408. As shown in the depicted image the fastener alignment openings may be openings or slots, or in other examples, other forms of fastener alignments may be used. In the depicted example, refrigerant leak sensor 210 is coupled to the bracket.

In the examples depicted in FIGS. 4A-C, the extended arm 406 in bracket 400 includes a first portion 410 and a second portion 412. The first portion may extend substantially perpendicular to a plane defined by the surface 402 of the bracket. The second portion may extend substantially parallel to that same plane, e.g., the plane defined by the first or second sides in the depicted example.

FIG. 4B shows a side view of the bracket 400 and the extend arm 406. In this example, the first portion 410 may extend horizontally from the surface 402 by a length 414, potentially a first length. In some examples, the length 414 is sized based on the thickness of a wall 304 of a drain pan 208. For example, the length 414 may be sized larger than the thickness of a wall of the drain pan. In some examples, potentially examples where the bracket may be attached to multiple drain pans or multiple locations on a given drain pan, the length 414 is sized such that it is thicker than all of the walls the bracket may be coupled to.

The example depicted in FIG. 4B also includes a first portion 410 that extends from the surface 402 at a slight angle towards an edge. In this example, the first portion extends substantially perpendicular to the plane defined by the surface of the bracket and at an angle 416 towards an edge 404 of the bracket. In the example depicted in FIG. 4B, the second portion 412 also extends from the first portion at an angle 418. In this example, the angle is such that the second portion extends substantially parallel to the surface of the bracket and at an angle towards the surface of the bracket. As shown, this angle results in the extended arm being progressively closer to surface 402, e.g., the second portion 412 of the extend arm 406 is closer to surface 402 at edge 404 than where the second portion attaches to the first portion. In this example, the orientation of the first and second portions may allow additional flexibility to allow the extended arm 406 to engage with various different walls 304 of different drain pans 208. For example, the angle 416 associated with the first portion and the surface of the bracket may allow the extended arm 406 to adjust in order to accommodate different wall thicknesses. In some examples, the angle 418 associated with the second portion relative to the surface of the bracket may allow the second portion to engage with a surface of the wall of the drain pan, potentially securing or assisting in securing the bracket to the drain pan wall. In some examples, the bracket comprises metal or plastic which has some flexibility and can also allow the portions of the extended arm to engage with the bracket in these manners. For example, the flexibility may allow the extended arm to serve as a spring, applying a spring force which may assist in further securing and retaining the bracket to the drain pan.

Figure 4D:
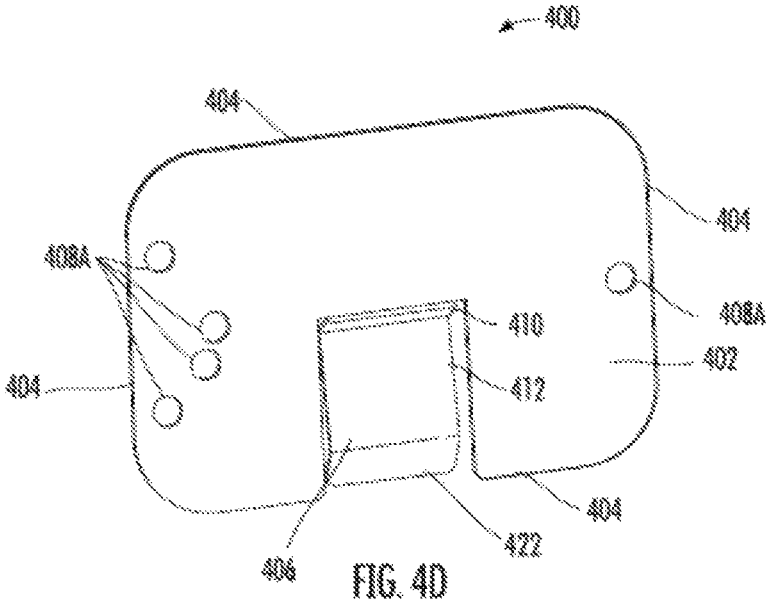
FIG. 4D illustrates an example of a bracket according to some examples of the present disclosure.
Figure 4E:
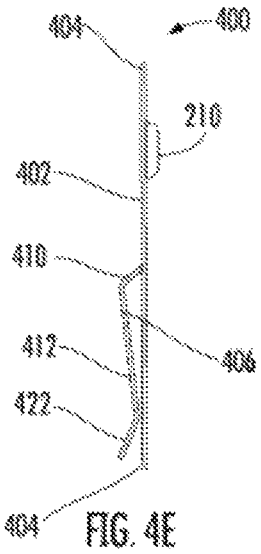
FIG. 4E illustrates an example of a bracket according to some examples of the present disclosure.

In the examples depicted in FIGS. 4D and 4E the extend arm 406 also includes a tab 422 that extends from the end of the first portion 410. As shown in this example, the tab angles away from the surface 402, e.g., it flares out. This tab may assist in allowing the extend arm to engage with a wall 304 of a drain pan 208, for example, by directing the bracket to engage with the wall between the extend arm and the surface of the bracket. In addition, in examples where the extend arm is flexible and serves as a spring, the tab may assist in flexing the extended arm away from the surface while the bracket is being located. Some examples may not include a tab and/or include a different design.

In some examples, the extended arm 406 of the bracket 400 may protrude from the surface of the bracket at a set distance from an edge of the bracket as shown in FIG. 4C. For example, as shown in the depicted bracket, the extended arm protrudes from the surface 402 at a distance 420 from an edge 404 in the orientation shown in FIG. 4C. In some examples, the distance 420 from a given edge is set to a specific distance in order to locate the refrigerant leak sensor 210 at a preferred location relative to the drain pan and/or features associated with the drain pan. For example, the distance 420 may be set to position the refrigerant leak sensor at any of the distances discussed above, e.g., the first, second, and/or third distance (338, 340, 342, etc.), or other locations. In some examples, the extended arm protrudes from the surface at a given distance from any of the other edges or features of the bracket in order to position the refrigerant leak sensor on a drain pan in a given position.

In some examples, the bracket 400 includes multiple extended arms 406. In these examples, each of the extended arms may be sized and/or arranged to position the refrigerant leak sensor 210 at a given location. In these examples, the different extended arms may be arranged to position the refrigerant leak sensor at the appropriate position on different drain pans 208, e.g., each extended arm may be designed for one or more drain pans. In some examples, the different extended arms may be arranged to position the refrigerant leak sensor at the appropriate position when the bracket is coupled to different locations on the same drain pan, e.g., each extended arm may be designed for a given location on a drain pan. In some examples, the different extended arms may be designed to locate the refrigerant leak sensor at different positions relative to the drain pan or drain pan features. These different designs may be combined and/or adjusted in additional manners.

In some further examples, the bracket 400 includes fastener alignment openings 408 for attaching the bracket to a wall 304 of a drain pan 208. In these examples, the bracket may also include an extended arm 406 for attaching the bracket to a wall of the drain pan. As shown, in FIGS. 4A and 4C, the fastener alignment openings may come in various forms, e.g., the holes 408A, slots 408B, or other forms not shown, and these fastener alignment openings may be located at various points on the bracket. Similar, to the discussion above regarding the extended arm, the fastener alignment openings may be design to located the refrigerant leak sensor 308 via the bracket at various desired locations on the different drain pans, different locations on the same drain pan, and/or different positions relative to the drain pan. In some examples, the fastener alignment openings align to different drain pans, locations, and/or positions than the extended arm. For example, an extended arm for a bracket may attach the bracket to a wall of the drain pan, and the bracket may also include fastener alignment openings for attaching the bracket to a wall of a different drain pan. In some examples, the fastener alignment openings provide redundancy to an extended arm at a given location. In some examples, the fastener alignment openings and/or the extended arm are used to couple the refrigerant leak sensor to the bracket, and in these examples, the fastener alignment openings and/or the extended arm may position the refrigerant leak sensor in a desired location in a similar manner as discussed above.

Returning to FIGS. 2A-D, in some examples, the air handler unit 200 includes control circuitry 212. In some examples, the control circuitry is coupled to the refrigerant leak sensor 210. In these examples, the control circuitry may receive a signal from the refrigerant leak sensor indicative of refrigerant located outside the closed circuit 101, and in some of these examples, the control circuitry may determine a refrigerant leak has occurred based on the signal. This signal may be in any form, e.g., digital, analog, wired, wireless, etc. In addition, any refrigerant leak sensor or detector may be used that is configured to sense refrigerant, e.g., electrical conductive sensor, metal-oxide sensor (MOS), non-dispersive infrared (NDIR) sensor, thermal conductivity sensor, acoustic sensor, ultrasonic sensor, and oxygen sensor. In some examples, the refrigerant leak sensor is a refrigerant sensor, which directly detects the presents of refrigerant. In other examples, the refrigerant leak sensor is another type of sensor, potentially a leak sensor, which indirectly detects refrigerant by monitoring other substance or characteristics which indicate a refrigerant is present, e.g., an oxygen sensor indicating that a volume displacement has occurred in the space often demonstrating a refrigerant leak has occurred. The control circuitry may receive this signal and make a determination that a refrigerant leak has occurred, e.g., that refrigerant is located outside the closed circuit. In some examples, the control circuitry may take further action based on this determination. For example, the control circuitry may issue an alarm and/or display a message indicating that a refrigerant leak had occurred. In other examples, the control circuitry may control various components of the climate control system, potentially to mitigate the impact of the refrigerant leak.

In some examples, the control circuitry 212 includes control circuitry that is coupled to the fan 204, and in these examples, the control circuitry may control the operation of the fan. For example, the control circuitry may increase the operating speed of the fan in response to the determination that a refrigerant leak has occurred. In some examples, this may include turning the fan from an off-state, where the fan is not operating, to an on-state, where the fan is operating. In some examples, increasing the operating speed of the fan may include adjusting the fan from a normal operating speed, potentially based on conditioning controls, to an increased operating speed.

In some examples, the control circuitry 212 includes control circuitry that is coupled to the compressor 120, and in these examples, the control circuitry may control the operation of the compressor. In these examples, the control circuitry may prevent operation of the compressor in response to the determination that the refrigerant leak has occurred. In some examples, this includes shutting off the compressor, and in some examples, the compressor is already off and the compressor is prevented from turning back on. In some examples, prevent operation of the compressor is part of a shut down for the entire climate control system 100. In some examples, the compressor is one of a sub-set of components within the climate control system that is shut off. In some examples, the control circuitry also closes various valves, potentially one or more of the valves associated with the metering device, when the determination has been made that a refrigerant leak has occurred.

In some examples, the climate control system 100 includes an orientation sensor 240 (see FIGS. 2A-D). The orientation sensor may assist in confirming the refrigerant leak sensor is properly located and/or oriented. In these examples, the orientation sensor may be any type of sensor, e.g., accelerometer, tilt sensor, MEMS device, ball in channel, etc.

In some examples, the orientation sensor 240 is coupled to the refrigerant leak sensor. In these examples, the orientation sensor may send a signal indicative of the orientation of the refrigerant leak sensors. For example, the orientation sensor may be physically coupled to the refrigerant leak sensor, e.g., located within the same housing, attached to a common bracket, etc. In other examples, the orientation sensor may be coupled in a different manner, e.g., electrically, etc., such that the orientation sensor is able to determine the orientation of the refrigerant leak sensor, e.g., horizontal, vertical, etc.

In some examples, the control circuitry 212 includes control circuitry coupled to the orientation sensor 240. In these examples, the control circuitry may receive signals from the orientation sensor. These signals may be received in any conventional manner, e.g., wired, wireless, digital, analog, etc. In some examples, the orientation of the refrigerant leak sensor is inputted by manual input, e.g., by a technician, installer, etc.

In some examples, the control circuitry 212 includes control circuitry to determine the orientation of the refrigerant leak sensor 210 based on signals from the orientation sensor 240. In these examples, the control circuitry may further include control circuitry that confirms the refrigerant leak sensor is in the proper orientation to detect refrigerant outside the closed circuit. For example, when the refrigerant leak sensor is properly located it may be oriented on the drain pan in a given orientation, e.g., a horizontal orientation, a vertical orientation, or another orientation. The signal provided by the orientation sensor may provide an indication of the refrigerant leak sensors actual orientation, e.g., a horizontal orientation, a vertical orientation, or another orientation. This actual orientation may be compared with the desired or designed orientation of the refrigerant leak sensor to determine if the refrigerant leak sensor is properly located. The control circuitry may make this comparison, e.g., comparing the sensed orientation to the designed orientation, to confirm the refrigerant leak sensor was located on the appropriate drain pan or at the appropriate drain pan location. In some examples, the confirmation may indicate that the drain pan has not been moved to the appropriate location. For example, the refrigerant leak sensor may be designed to be positioned substantially horizontally when properly mounted to an active drain pan. In this example, if the refrigerant leak sensor is determined to be substantially vertical, this may indicate that the refrigerant leak sensor remains attached to an inactive drain pan in the current pose of the HVAC unit and the refrigerant leak sensor can prevent operation of the unit until the sensor is moved to the active drain pan. In some examples, the control circuitry further provides a signal, potentially an alert, that the sensed orientation of the refrigerant leak sensor indicates the refrigerant leak sensor is not properly located. In some examples, the control circuitry will prevent normal operation of the equipment if the sensed orientation of the refrigerant leak sensor indicates the refrigerant leak sensor is not properly located. In some examples, the control circuitry provides a signal that the sensed orientation of the refrigerant leak sensor indicates the refrigerant leak sensor is properly located.

FIGS. 5A-5E are flowcharts illustrating various steps in a method 500 for installing an air handler unit 200 at a location. This method may include orienting the air handler unit at the location in one of a plurality of orientation such that the fan 204 is in fluid communication with a return air path 216 and a supply air path 218 associated with the conditioned space, as shown in block 502 of FIG. 5A. The method may also include locating the drain pan 208 to collect condensate produced at the heat exchanger 206, as shown in block 504. The method may further include positioning the refrigerant leak sensor 210 a first distance 338 along an axis 336 normal to the first and second planes (310 and 320), the first distance measured as the distance from the refrigerant leak sensor to the first plane and sized such that the first distance is greater than or equal to a second distance 340 measured along the axis from the first plane to the second plane, as shown in block 506. The method may also include coupling the refrigerant leak sensor to the drain pan, as shown in block 508, and in some examples, the method may include connecting the refrigerant leak sensor to control circuitry 212, as shown in block 510.

In some examples, locating the drain pan 208 may further include arranging the drain pan and the refrigerant leak sensor 210 at a first drain pan position 230A, as shown in block 512 of FIG. 5B. These examples may also include removing the drain pan and the refrigerant leak sensor from the first drain pan position, as shown in block 514, and may further include arranging the drain pan and the refrigerant leak sensor in a second drain pan position 230B, the first and second drain pan positions being on different walls 214 of a housing 202 of a climate control system 100, as shown in block 516.

In some examples, coupling the refrigerant leak sensor 210 to the drain pan 208 may further include coupling the refrigerant leak sensor to the first drain pan 208A, as shown in block 518 of FIG. 5C. In these examples, the method may also include detaching the refrigerant leak sensor from the first drain pan, as shown in block 520. These examples may further include coupling the refrigerant leak sensor to the second drain pan 208B, as shown in block 522.

In some examples, coupling the refrigerant leak sensor 210 to the drain pan 208 includes coupling the refrigerant leak sensor to a bracket 400 as shown in block 524 of FIG. 5D. In these examples, the method may further include coupling the bracket to the drain pan as shown in block 526.

In some examples, positioning the refrigerant leak sensor 210 further includes positioning the refrigerant leak sensor such that the first distance 338 is greater than the second distance 340 by 1 inch or less, as shown in block 528 of FIG. 5E. In some examples, positioning the refrigerant leak sensor further includes positioning the refrigerant leak sensor such that the first distance 238 is less than the third distance 242 by an amount such that the location for the refrigerant leak sensor is below the point 332 along the distal edge 334 of the spillover wall 328, the amount being 1 inch or less, as shown in block 530 of FIG. 5F.

In some examples, the method 500 further comprises coupling the fan 204 and a compressor of the climate control system 100 to the control circuitry 212, as shown in block 532 of FIG. 5G. In some examples, one or more of these components are already coupled to the control circuitry.

In some examples, the method 500 further comprises receiving signals from the orientation sensor at the control circuitry, as shown in block 534 of FIG. 5H. In some examples, the method further includes determining the orientation of the refrigerant leak sensor based on signals from the orientation sensor, as shown in block 536. The method may also include confirming that the refrigerant leak sensor is in the proper orientation to detect refrigerant located outside the closed circuit, as shown in block 538.

FIG. 6 illustrates the control circuitry 212 according to some example implementations of the present disclosure. The control circuitry may include one or more of each of a number of components such as, for example, a processor 602 connected to a memory 604. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit is at times more commonly referred to as a "chip"). The processor 602 may be a number of processors, a multi-core processor, or some other type of processor, depending on the particular implementation.

The processor 602 may be configured to execute computer programs such as computer-readable program code 606, which may be stored onboard the processor or otherwise stored in the memory 604. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 604 is generally any piece of computer hardware capable of storing information, such as, for example, data, computer-readable program code 606 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein, which, in response to execution by the processor 602, causes the control circuitry 212 to perform various operations as described herein, some of which may in turn cause the climate control system 100 to perform various operations.

In addition to the memory 604, the processor 602 may also be connected to one or more peripherals such as a network adapter 608, one or more input/output (I/O) devices 610, or the like. The network adapter is a hardware component configured to connect the control circuitry 212 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A climate control system comprising: a heat exchanger coupled to a closed circuit of the climate control system for routing a refrigerant fluid, the heat exchanger being configured to exchange thermal energy between a conditioned airflow and the refrigerant fluid; one or more drain pans, at least one drain pan arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane; a refrigerant leak sensor coupled to the drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, the refrigerant leak sensor configured to detect refrigerant located outside the closed circuit; and control circuitry operably coupled to the refrigerant leak sensor, the control circuitry configured to: receive a signal from the refrigerant leak sensor indicative of refrigerant located outside the closed circuit, and determine a refrigerant leak has occurred based on the signal.

Clause 2. The climate control system in any of the preceding clauses, further comprising a housing, the housing including the heat exchanger, the at least one drain pan, and the refrigerant leak sensor.

Clause 3. The climate control system in any of the preceding clauses, wherein the housing includes a first drain pan position and a second drain pan position, the first and second drain pan positions being on different walls of the housing and each configured to alternatively support the at least one drain pan and the refrigerant leak sensor coupled to the at least one drain pan.

Clause 4. The climate control system in any of the preceding clauses, wherein the at least one drain pan includes a first drain pan and a second drain pan, the first and second drain pans located at different locations within the housing such that the first drain pan is active in a first orientation and inactive in a second orientation and the second drain pan is active in the second orientation and inactive in the first orientation, wherein the refrigerant leak sensor is detachably coupled to the first drain pan such that the refrigerant leak sensor may be detached from the first drain pan and attached to the second drain pan.

Clause 5. The climate control system in any of the preceding clauses, further comprising a bracket for coupling the refrigerant leak sensor to the at least one drain pan.

Clause 6. The climate control system in any of the preceding clauses, wherein the bracket is configured to couple the refrigerant leak sensor to two or more different drain pans.

Clause 7. The climate control system in any of the preceding clauses, wherein the bracket is configured to couple the refrigerant leak sensor to two or more locations on the drain pan.

Clause 8. The climate control system in any of the preceding clauses, wherein the bracket includes an extended arm protruding from a surface of the bracket, the extended arm including a first portion and a second portion, the first portion extending substantially perpendicular to a plane defined by the surface of the bracket, the second portion extending substantially parallel to the plane defined by the surface of the bracket.

Clause 9. The climate control system in any of the preceding clauses, wherein the extended arm protrudes from the surface of the bracket at a set distance from an edge of the bracket, the set distance being sized to locate the refrigerant leak sensor at the first distance.

Clause 10. The climate control system in any of the preceding clauses, wherein the first portion extends from the surface of the bracket a first length, the first length being sized larger than a thickness of a wall of the drain pan, and wherein the second portion extends from the first portion at an angle, such that the second portion extends substantially parallel to the surface of the bracket and at an angle towards the surface of the bracket.

Clause 11. The climate control system in any of the preceding clauses, wherein the extended arm is configured to attach the bracket to a wall of the drain pan, and wherein the bracket further includes fastener alignment openings for attaching the bracket to a wall of a different drain pan.

Clause 12. The climate control system in any of the preceding clauses, wherein the location of the refrigerant leak sensor is such that the first distance is greater than the second distance by 1 inch or less.

Clause 13. The climate control system in any of the preceding clauses, wherein the drain pan further includes a spillover wall, the spillover wall extending substantially vertically relative to the bottom surface of the drain pan and defining a third plane parallel to the first and second planes, the third plane defined as a closest plane parallel to the first plane that is tangent to a point along a distal edge of the spillover wall, the third plane further defining a third distance measured as the distance between the first and third planes along the axis, wherein the first distance is less than the third distance by an amount such that the location for the refrigerant leak sensor is above the point along the distal edge of the spillover wall, the amount being less than or equal to 1 inch.

Clause 14. The climate control system in any of the preceding clauses, further comprising a fan configured to circulate the conditioned airflow through the heat exchanger and into a conditioned space, and a compressor configured to circulate the refrigerant fluid through the closed circuit, wherein the control circuitry is further operably coupled to the fan and the compressor and configured to increase an operating speed of the fan and prevent operation of the compressor in response to the determination that the refrigerant leak has occurred.

Clause 15. further comprising an orientation sensor coupled to the refrigerant leak sensor, the orientation sensor configured to send a signal indicative of the orientation of the refrigerant leak sensors, wherein the control circuitry is further coupled to the orientation sensor and further configured to receive signals from the accelerometer, determine the orientation of the refrigerant leak sensor based on signals from the orientation sensor, and confirm that the refrigerant leak sensor is in the proper orientation to detect refrigerant located outside the closed circuit.

Clause 16. An air handler unit comprising: a housing, the housing including: a fan configured to circulate a conditioned airflow through a heat exchanger and into a conditioned space; the heat exchanger coupled to a closed circuit of the climate control system for routing a refrigerant fluid, the heat exchanger being configured to exchange thermal energy between the conditioned airflow and the refrigerant fluid; one or more drain pans, at least one drain pan arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane; and a refrigerant leak sensor coupled to the drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, the refrigerant leak sensor configured to detect refrigerant located outside the closed circuit.

Clause 17. The air handler unit in any of the preceding clauses, wherein the housing includes a first drain pan position and a second drain pan position, the first and second drain pan positions associated with different walls of the housing and each configured to alternatively support the drain pan and the refrigerant leak sensor coupled to the at least one drain pan.

Clause 18. The air handler unit in any of the preceding clauses, wherein the at least one drain pan includes a first drain pan and a second drain pan, the first and second drain pans located at different locations within the housing such that the first drain pan is active in a first orientation and inactive in a second orientation and the second drain pan is active in the second orientation and inactive in the first orientation, wherein the refrigerant leak sensor is detachably coupled to the first drain pan such that the refrigerant leak sensor may be detached from the first drain pan and attached to the second drain pan.

Clause 19. The air handler unit in any of the preceding clauses, further comprising a bracket for coupling the refrigerant leak sensor to the at least one drain pan.

Clause 20. The air handler unit in any of the preceding clauses, wherein the bracket is configured to couple the refrigerant leak sensor to two or more different drain pans.

Clause 21. The air handler unit in any of the preceding clauses, wherein the bracket is configured to couple the refrigerant leak sensor to two or more locations on the drain pan.

Clause 22. The air handler unit in any of the preceding clauses, wherein the bracket includes an extended arm protruding from a surface of the bracket, the extended arm including a first portion and a second portion, the first portion extending substantially perpendicular to a plane defined by the surface of the bracket, the second portion extending substantially parallel to the plane defined by the surface of the bracket.

Clause 23. The air handler unit in any of the preceding clauses, wherein the extended arm protrudes from the surface of the bracket at a set distance from an edge of the bracket, the set distance being sized to locate the refrigerant leak sensor at the first distance.

Clause 24. The air handler unit in any of the preceding clauses, wherein the first portion extends from the surface of the bracket a first length, the first length being sized larger than a thickness of a wall of the drain pan, and wherein the second portion extends from the first portion at an angle, such that the second portion extends substantially parallel to the surface of the bracket and at an angle towards the surface of the bracket.

Clause 25. The air handler unit in any of the preceding clauses, wherein the extended arm is configured to attach the bracket to a wall of the drain pan, and wherein the bracket further includes fastener alignment openings for attaching the bracket to a wall of a different drain pan.

Clause 26. The air handler unit in any of the preceding clauses, wherein the location of the refrigerant leak sensor is such that the first distance is greater than the second distance by 1 inch or less.

Clause 27. The air handler unit in any of the preceding clauses, wherein the drain pan further includes a spillover wall, the spillover wall extending substantially vertically relative to the bottom surface of the drain pan and defining a third plane parallel to the first and second planes, the third plane defined as a closest plane parallel to the first plane that is tangent to a point along a distal edge of the spillover wall, the third plane further defining a third distance measured as the distance between the first and third planes along the axis, wherein the first distance is less than the third distance by an amount such that the location for the refrigerant leak sensor is below the point along the distal edge of the spillover wall, the amount being 1 inch or less.

Clause 28. The air handler unit in any of the preceding clauses, further comprising control circuitry operably coupled to the refrigerant leak sensor, the control circuitry configured to: receive a signal from the refrigerant leak sensor indicative of refrigerant located outside the closed circuit, and determine a refrigerant leak has occurred based on the signal Clause 29. The air handler unit in any of the preceding clauses, wherein the control circuitry is further operably coupled to the fan and a compressor, the control circuitry further configured to increase an operating speed of the fan and prevent operation of the compressor in response to the determination that the refrigerant leak has occurred.

Clause 30. The air handler unit in any of the preceding clauses, further comprising an orientation sensor coupled to the refrigerant leak sensor, the orientation sensor configured to send a signal indicative of the orientation of refrigerant leak sensors, wherein the control circuitry is further coupled to the orientation sensor and further configured to receive signals from the orientation sensor, determine the orientation of the refrigerant leak sensor based on signals from the orientation sensor, and confirm that the refrigerant leak sensor is in the proper orientation to detect refrigerant located outside the closed circuit.

Clause 31. A method for installing an air handler unit at a location, the air handler unit including a housing including a fan configured to circulate a conditioned airflow through a heat exchanger and into a conditioned space, the heat exchanger coupled to a closed circuit of the climate control system for routing a refrigerant fluid, one or more drain pans configured to collect condensate produced at a heat exchanger, and a refrigerant leak sensor configured to detect refrigerant located outside the closed circuit, the method comprising: orienting the air handler unit at the location in one of a plurality of orientation such that the fan is in fluid communication with a return air path and a supply air path associated with the conditioned space; locating at least one of the one or more drain pans to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane; positioning the refrigerant leak sensor a first distance along an axis normal to the first and second planes, the first distance measured as the distance from the refrigerant leak sensor to the first plane and sized such that the first distance is greater than or equal to a second distance measured along the axis from the first plane to the second plane; coupling the refrigerant leak sensor to the drain pan; and connecting the refrigerant leak sensor to control circuitry.

Clause 32. The method in any of the preceding clauses, wherein locating the drain pan further includes: arranging the at least one drain pan and the refrigerant leak sensor at a first drain pan position, removing the at least one drain pan and the refrigerant leak sensor from the first drain pan position, and arranging the at least one drain pan and the refrigerant leak sensor in a second drain pan position, the first and second drain pan positions being on different sides of a housing of a climate control system.

Clause 33. The method in any of the preceding clauses, wherein the at least one drain pan includes a first drain pan and a second drain pan, the first and second drain pans located on different sides of the housing, and wherein coupling the refrigerant leak sensor to the at least one drain pan further includes: coupling the refrigerant leak sensor to the first drain pan; detaching the refrigerant leak sensor from the first drain pan; and coupling the refrigerant leak sensor to the second drain pan.

Clause 34. The method in any of the preceding clauses, wherein coupling the refrigerant leak sensor to the drain pan further includes coupling the refrigerant leak sensor to a bracket and coupling the bracket to the at least one drain pan, wherein the bracket is configured to couple the refrigerant leak sensor to two or more different drain pans.

Clause 35. The method in any of the preceding clauses, wherein positioning the refrigerant leak sensor further includes positioning the refrigerant leak sensor such that the first distance is greater than the second distance by 1 inch or less.

Clause 36. The method in any of the preceding clauses, wherein the drain pan further includes a spillover wall, the spillover wall extending substantially vertically from the bottom surface of the drain pan and defining a third plane parallel to the first and second planes, the third plane defined as a closest plane parallel to the first plane that is tangent to a point along a distal edge of the spillover wall, the third plane further defining a third distance measure as the distance between the first and third planes along the axis, wherein positioning the refrigerant leak sensor further includes positioning the refrigerant leak sensor such that the first distance is less than the third distance such that the location for the refrigerant leak sensor is below the point along the distal edge of the spillover wall, the amount being 1 inch or less.

Clause 37. The method in any of the preceding clauses, wherein the control circuitry is further operably coupled to a fan and a compressor of a climate control system, the control circuitry further configured to increase the operating speed of the fan and prevent operation of the compressor in response to the determination that the refrigerant leak has occurred.

Clause 38. The method in any of the preceding clauses, wherein the air handler further comprises an orientation sensor coupled to the refrigerant leak sensor and the control circuitry, the orientation sensor configured to send a signal indicative of the orientation of refrigerant leak sensors, and the method further comprises: receiving signals from the orientation sensor at the control circuitry; determining the orientation of the refrigerant leak sensor based on signals from the orientation sensor; and confirming that the refrigerant leak sensor is in the proper orientation to detect refrigerant located outside the closed circuit.

Many modifications and other examples of the disclosure set forth herein will come to mind to one skilled in the art to which the disclosure pertains having the benefit of the teachings presented in the foregoing description and the associated figures. Therefore, it is to be understood that the disclosure is not to be limited to the specific examples disclosed and that modifications and other examples are intended to be included within the scope of the appended claims. Moreover, although the foregoing description and the associated figures describe examples in the context of certain example combinations of elements and/or functions, it should be appreciated that different combinations of elements and/or functions may be provided by alternative examples without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A climate control system comprising:

a heat exchanger coupled to a closed circuit of the climate control system for routing a refrigerant fluid, the heat exchanger being configured to exchange thermal energy between a conditioned airflow and the refrigerant fluid;

two or more drain pans including a first drain pan and a second drain pan, at least one drain pan of the first and second drain pans being arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane;

a refrigerant leak sensor coupled to the at least one drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, the refrigerant leak sensor configured to detect refrigerant located outside the closed circuit;

a housing, the housing including the heat exchanger, the first drain pan, the second drain pan, and the refrigerant leak sensor;

wherein the first and second drain pans are located at different locations within the housing such that the first drain pan is active in a first orientation and inactive in a second orientation and the second drain pan is active in the second orientation and inactive in the first orientation, wherein the at least one drain pan is the first drain pan and the refrigerant leak sensor is detachably coupled to the first drain pan such that the refrigerant leak sensor may be detached from the first drain pan and attached to the second drain pan; and control circuitry operably coupled to the refrigerant leak sensor, the control circuitry configured to:

receive a signal from the refrigerant leak sensor indicative of refrigerant located outside the closed circuit, and determine a refrigerant leak has occurred based on the signal.

2. The climate control system of claim 1, further comprising a bracket for coupling the refrigerant leak sensor to the at least one drain pan.

3. The climate control system of claim 2, wherein the bracket is configured to couple the refrigerant leak sensor to two or more different drain pans.

4. The climate control system of claim 2, wherein the bracket is configured to couple the refrigerant leak sensor to two or more locations on the at least one drain pan.

5. The climate control system of claim 2, wherein the bracket includes an extended arm protruding from a surface of the bracket, the extended arm including a first portion and a second portion, the first portion extending substantially perpendicular to a plane defined by the surface of the bracket, the second portion extending substantially parallel to the plane defined by the surface of the bracket.

6. The climate control system of claim 5, wherein the extended arm protrudes from the surface of the bracket at a set distance from an edge of the bracket, the set distance being sized to locate the refrigerant leak sensor at the first distance.

7. The climate control system of claim 5, wherein the first portion extends from the surface of the bracket a first length, the first length being sized larger than a thickness of a wall of the drain pan, and wherein the second portion extends from the first portion at an angle, such that the second portion extends substantially parallel to the surface of the bracket and at an angle towards the surface of the bracket.

8. The climate control system of claim 1, wherein the location of the refrigerant leak sensor is such that the first distance is greater than second distance by 1 inch or less.

9. The climate control system of claim 1, wherein the at least one drain pan further includes a spillover wall, the spillover wall extending substantially vertically relative to the bottom surface of the drain pan and defining a third plane parallel to the first and second planes, the third plane defined as a closest plane parallel to the first plane that is tangent to a point along a distal edge of the spillover wall, the third plane further defining a third distance measured as the distance between the first and third planes along the axis, wherein the first distance is less than the third distance by an amount such that the location for the refrigerant leak sensor is below the point along the distal edge of the spillover wall, the amount being 1 inch or less.

10. The climate control system of claim 1, further comprising a fan configured to circulate the conditioned airflow through the heat exchanger and into a conditioned space, and a compressor configured to circulate the refrigerant fluid through the closed circuit, wherein the control circuitry is further operably coupled to the fan and the compressor, and further configured to increase an operating speed of the fan and prevent operation of the compressor in response to the determination that the refrigerant leak has occurred.

11. The climate control system of claim 1, further comprising an orientation sensor coupled to the refrigerant leak sensor, the orientation sensor configured to send a signal indicative of the orientation of the refrigerant leak sensors, wherein the control circuitry is further coupled to the orientation sensor and further configured to receive signals from the orientation sensor, determine the orientation of the refrigerant leak sensor based on signals from the orientation sensor, and confirm that the refrigerant leak sensor is in proper orientation to detect refrigerant located outside the closed circuit.

12. A method for installing an air handler unit at a location, the air handler unit including a housing including a fan configured to circulate a conditioned airflow through a heat exchanger and into a conditioned space, the heat exchanger coupled to a closed circuit of a climate control system for routing a refrigerant fluid, one or more drain pans configured to collect condensate produced at a heat exchanger, and a refrigerant leak sensor configured to detect refrigerant located outside the closed circuit, the method comprising:

orienting the air handler unit at the location in one of a plurality of orientation such that the fan is in fluid communication with a return air path and a supply air path associated with the conditioned space;

locating at least one of the one or more drain pans to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane;

positioning the refrigerant leak sensor a first distance along an axis normal to the first and second planes, the first distance measured as the distance from the refrigerant leak sensor to the first plane and sized such that the first distance is greater than or equal to a second distance measured along the axis from the first plane to the second plane;

coupling the refrigerant leak sensor to the at least one drain pan, wherein coupling the refrigerant leak sensor to the drain pan further includes coupling the refrigerant leak sensor to a bracket and coupling the bracket to the at least one drain pan, wherein the bracket is configured to couple the refrigerant leak sensor to two or more different drain pans; and connecting the refrigerant leak sensor to control circuitry.

13. The method of claim 12, wherein positioning the refrigerant leak sensor further includes positioning the refrigerant leak sensor such that the first distance is greater than the second distance by 1 inch or less.

14. The method of claim 12, wherein the at least one drain pan further includes a spillover wall, the spillover wall extending substantially vertically from the bottom surface of the drain pan and defining a third plane parallel to the first and second planes, the third plane defined as a closest plane parallel to the first plane that is tangent to a point along a distal edge of the spillover wall the third plane further defining a third distance measure as the distance between the first and third planes along the axis, wherein positioning the refrigerant leak sensor further includes positioning the refrigerant leak sensor such that the first distance is less than the third distance by an amount such that the location for the refrigerant leak sensor is below the point along the distal edge of the spillover wall, the amount being 1 inch or less.

15. The method of claim 12, wherein the control circuitry is further operably coupled to a fan and a compressor of a climate control system, the control circuitry further configured to increase the operating speed of the fan and prevent operation of the compressor in response to the determination that the refrigerant leak has occurred.

16. The method of claim 12, wherein the air handler further comprises an orientation sensor coupled to the refrigerant leak sensor and the control circuitry, the orientation sensor configured to send a signal indicative of the orientation of refrigerant leak sensors, and the method further comprises:

receiving signals from the orientation sensor at the control circuitry;

determining the orientation of the refrigerant leak sensor based on signals from the orientation sensor; and confirming that the refrigerant leak sensor is in a proper orientation to detect refrigerant located outside the closed circuit.

17. A climate control system comprising:

a heat exchanger coupled to a closed circuit of the climate control system for routing a refrigerant fluid, the heat exchanger being configured to exchange thermal energy between a conditioned airflow and the refrigerant fluid;

one or more drain pans, at least one drain pan arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane;

a refrigerant leak sensor coupled to the at least one drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, the refrigerant leak sensor configured to detect refrigerant located outside the closed circuit;

a bracket for coupling the refrigerant leak sensor to the at least one drain pan, wherein the bracket is configured to couple the refrigerant leak sensor to two or more different drain pans; and control circuitry operably coupled to the refrigerant leak sensor, the control circuitry configured to:

receive a signal from the refrigerant leak sensor indicative of refrigerant located outside the closed circuit, and determine a refrigerant leak has occurred based on the signal.

18. The climate control system of claim 17, further comprising a housing, the housing including the heat exchanger, the at least one drain pan, and the refrigerant leak sensor.

19. The climate control system of claim 18, wherein the housing includes a first drain pan position and a second drain pan position, the first and second drain pan positions being on different walls of the housing and each configured to alternatively support the at least one drain pan and the refrigerant leak sensor coupled to the at least one drain pan.

20. The climate control system of claim 17, wherein the bracket is configured to couple the refrigerant leak sensor to two or more locations on the at least one drain pan.

21. The climate control system of claim 17, wherein the bracket includes an extended arm protruding from a surface of the bracket, the extended arm including a first portion and a second portion, the first portion extending substantially perpendicular to a plane defined by the surface of the bracket, the second portion extending substantially parallel to the plane defined by the surface of the bracket.

22. The climate control system of claim 21, wherein the extended arm protrudes from the surface of the bracket at a set distance from an edge of the bracket, the set distance being sized to locate the refrigerant leak sensor at the first distance.

23. The climate control system of claim 22, wherein the first portion extends from the surface of the bracket a first length, the first length being sized larger than a thickness of a wall of the drain pan, and wherein the second portion extends from the first portion at an angle, such that the second portion extends substantially parallel to the surface of the bracket and at an angle towards the surface of the bracket.

24. The climate control system of claim 17, wherein the location of the refrigerant leak sensor is such that the first distance is greater than second distance by 1 inch or less.

25. The climate control system of claim 17, wherein the at least one drain pan further includes a spillover wall, the spillover wall extending substantially vertically relative to the bottom surface of the drain pan and defining a third plane parallel to the first and second planes, the third plane defined as a closest plane parallel to the first plane that is tangent to a point along a distal edge of the spillover wall, the third plane further defining a third distance measured as the distance between the first and third planes along the axis, wherein the first distance is less than the third distance by an amount such that the location for the refrigerant leak sensor is below the point along the distal edge of the spillover wall, the amount being 1 inch or less.

26. The climate control system of claim 17, further comprising an orientation sensor coupled to the refrigerant leak sensor, the orientation sensor configured to send a signal indicative of the orientation of the refrigerant leak sensors, wherein the control circuitry is further coupled to the orientation sensor and further configured to receive signals from the orientation sensor, determine the orientation of the refrigerant leak sensor based on signals from the orientation sensor, and confirm that the refrigerant leak sensor is in proper orientation to detect refrigerant located outside the closed circuit.

27. A climate control system comprising:

a heat exchanger coupled to a closed circuit of the climate control system for routing a refrigerant fluid, the heat exchanger being configured to exchange thermal energy between a conditioned airflow and the refrigerant fluid;

one or more drain pans, at least one drain pan arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane;

a refrigerant leak sensor coupled to the at least one drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, the refrigerant leak sensor configured to detect refrigerant located outside the closed circuit;

a bracket for coupling the refrigerant leak sensor to the at least one drain pan, wherein the bracket includes an extended arm protruding from a surface of the bracket, the extended arm including a first portion and a second portion, the first portion extending substantially perpendicular to a plane defined by the surface of the bracket, the second portion extending substantially parallel to the plane defined by the surface of the bracket; and control circuitry operably coupled to the refrigerant leak sensor, the control circuitry configured to:

receive a signal from the refrigerant leak sensor indicative of refrigerant located outside the closed circuit, and determine a refrigerant leak has occurred based on the signal.

28. The climate control system of claim 27, further comprising a housing, the housing including the heat exchanger, the at least one drain pan, and the refrigerant leak sensor.

29. The climate control system of claim 28, wherein the housing includes a first drain pan position and a second drain pan position, the first and second drain pan positions being on different walls of the housing and each configured to alternatively support the at least one drain pan and the refrigerant leak sensor coupled to the at least one drain pan.

30. The climate control system of claim 28, wherein the one or more drain pans includes a first drain pan and a second drain pan, the first and second drain pans located at different locations within the housing such that the first drain pan is active in a first orientation and inactive in a second orientation and the second drain pan is active in the second orientation and inactive in the first orientation, wherein the at least one drain pain is the first drain pan and the refrigerant leak sensor is detachably coupled to the first drain pan such that the refrigerant leak sensor may be detached from the first drain pan and attached to the second drain pan.

31. The climate control system of claim 27, wherein the bracket is configured to couple the refrigerant leak sensor to two or more different drain pans.

32. The climate control system of claim 27, wherein the bracket is configured to couple the refrigerant leak sensor to two or more locations on the at least one drain pan.

33. The climate control system of claim 27, wherein the extended arm protrudes from the surface of the bracket at a set distance from an edge of the bracket, the set distance being sized to locate the refrigerant leak sensor at the first distance.

34. The climate control system of claim 27, wherein the first portion extends from the surface of the bracket a first length, the first length being sized larger than a thickness of a wall of the drain pan, and wherein the second portion extends from the first portion at an angle, such that the second portion extends substantially parallel to the surface of the bracket and at an angle towards the surface of the bracket.

35. The climate control system of claim 27, wherein the location of the refrigerant leak sensor is such that the first distance is greater than second distance by 1 inch or less.

36. The climate control system of claim 27, wherein the at least one drain pan further includes a spillover wall, the spillover wall extending substantially vertically relative to the bottom surface of the drain pan and defining a third plane parallel to the first and second planes, the third plane defined as a closest plane parallel to the first plane that is tangent to a point along a distal edge of the spillover wall, the third plane further defining a third distance measured as the distance between the first and third planes along the axis, wherein the first distance is less than the third distance by an amount such that the location for the refrigerant leak sensor is below the point along the distal edge of the spillover wall, the amount being 1 inch or less.

37. The climate control system of claim 27, further comprising an orientation sensor coupled to the refrigerant leak sensor, the orientation sensor configured to send a signal indicative of the orientation of the refrigerant leak sensors, wherein the control circuitry is further coupled to the orientation sensor and further configured to receive signals from the orientation sensor, determine the orientation of the refrigerant leak sensor based on signals from the orientation sensor, and confirm that the refrigerant leak sensor is in proper orientation to detect refrigerant located outside the closed circuit.

38. A climate control system comprising:

a heat exchanger coupled to a closed circuit of the climate control system for routing a refrigerant fluid, the heat exchanger being configured to exchange thermal energy between a conditioned airflow and the refrigerant fluid;

one or more drain pans, at least one drain pan arranged to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane, wherein the at least one drain pan further includes a spillover wall, the spillover wall extending substantially vertically relative to the bottom surface of the drain pan and defining a third plane parallel to the first and second planes, the third plane defined as a closest plane parallel to the first plane that is tangent to a point along a distal edge of the spillover wall;

a refrigerant leak sensor coupled to the at least one drain pan and positioned a first distance along an axis normal to the first and second planes, the first distance measured as the distance from the refrigerant leak sensor to the first plane and sized such that the first distance is greater than or equal to a second distance measured along the axis from the first plane to the second plane, wherein the third plane further defines a third distance measured as the distance between the first and third planes along the axis, and the first distance is less than the third distance by an amount such that the location for the refrigerant leak sensor is below the point along the distal edge of the spillover wall, the amount being 1 inch or less;

the refrigerant leak sensor configured to detect refrigerant located outside the closed circuit; and control circuitry operably coupled to the refrigerant leak sensor, the control circuitry configured to:

receive a signal from the refrigerant leak sensor indicative of refrigerant located outside the closed circuit, and determine a refrigerant leak has occurred based on the signal.

39. The climate control system of claim 38, further comprising a housing, the housing including the heat exchanger, the at least one drain pan, and the refrigerant leak sensor.

40. The climate control system of claim 39, wherein the housing includes a first drain pan position and a second drain pan position, the first and second drain pan positions being on different walls of the housing and each configured to alternatively support the at least one drain pan and the refrigerant leak sensor coupled to the at least one drain pan.

41. The climate control system of claim 38, further comprising a bracket for coupling the refrigerant leak sensor to the at least one drain pan.

42. The climate control system of claim 41, wherein the bracket is configured to couple the refrigerant leak sensor to two or more locations on the at least one drain pan.

43. The climate control system of claim 38, wherein the location of the refrigerant leak sensor is such that the first distance is greater than second distance by 1 inch or less.

44. The climate control system of claim 38, further comprising an orientation sensor coupled to the refrigerant leak sensor, the orientation sensor configured to send a signal indicative of the orientation of the refrigerant leak sensors, wherein the control circuitry is further coupled to the orientation sensor and further configured to receive signals from the orientation sensor, determine the orientation of the refrigerant leak sensor based on signals from the orientation sensor, and confirm that the refrigerant leak sensor is in proper orientation to detect refrigerant located outside the closed circuit.

45. A method for installing an air handler unit at a location, the air handler unit including a housing including a fan configured to circulate a conditioned airflow through a heat exchanger and into a conditioned space, the heat exchanger coupled to a closed circuit of a climate control system for routing a refrigerant fluid, one or more drain pans configured to collect condensate produced at a heat exchanger, and a refrigerant leak sensor configured to detect refrigerant located outside the closed circuit, the method comprising:

orienting the air handler unit at the location in one of a plurality of orientation such that the fan is in fluid communication with a return air path and a supply air path associated with the conditioned space;

locating at least one of the one or more drain pans to collect condensate produced at the heat exchanger, the at least one drain pan including a bottom surface and one or more drains configured to route condensate out of the at least one drain pan, the bottom surface defining a first plane tangent to a lowest point along the bottom surface, the one or more drains defining a second plane tangent to a highest point along the one or more drains and parallel to the first plane, wherein the at least one drain pan further includes a spillover wall, the spillover wall extending substantially vertically from the bottom surface of the drain pan and defining a third plane parallel to the first and second planes, the third plane defined as a closest plane parallel to the first plane that is tangent to a point along a distal edge of the spillover wall, the third plane further defining a third distance measure as the distance between the first and third planes along the axis;

positioning the refrigerant leak sensor a first distance along an axis normal to the first and second planes, the first distance measured as the distance from the refrigerant leak sensor to the first plane and sized such that the first distance is greater than or equal to a second distance measured along the axis from the first plane to the second plane, wherein positioning the refrigerant leak sensor further includes positioning the refrigerant leak sensor such that the first distance is less than the third distance by an amount such that the location for the refrigerant leak sensor is below the point along the distal edge of the spillover wall, the amount being 1 inch or less;

coupling the refrigerant leak sensor to the at least one drain pan; and connecting the refrigerant leak sensor to control circuitry.

46. The method of claim 45, wherein positioning the refrigerant leak sensor further includes positioning the refrigerant leak sensor such that the first distance is greater than the second distance by 1 inch or less.

47. The method of claim 45, wherein the air handler further comprises an orientation sensor coupled to the refrigerant leak sensor and the control circuitry, the orientation sensor configured to send a signal indicative of the orientation of refrigerant leak sensors, and the method further comprises:

receiving signals from the orientation sensor at the control circuitry;

determining the orientation of the refrigerant leak sensor based on signals from the orientation sensor; and confirming that the refrigerant leak sensor is in a proper orientation to detect refrigerant located outside the closed circuit.

* * * * *